US008955731B2

(12) United States Patent
Hashikawa

(10) Patent No.: US 8,955,731 B2
(45) Date of Patent: Feb. 17, 2015

(54) MULTIPLE ENDLESS BELT TYPE BAND SHEET COILING TENSION APPLYING APPARATUS

(75) Inventor: Yoshito Hashikawa, Sasebo (JP)

(73) Assignee: Japan Development Consultants, Inc., Sasebo (JP)

( * ) Notice: Subject to any disclaimer, the term of this patent is extended or adjusted under 35 U.S.C. 154(b) by 839 days.

(21) Appl. No.: 13/108,343

(22) Filed: May 16, 2011

(65) Prior Publication Data

US 2012/0085853 A1 Apr. 12, 2012

(30) Foreign Application Priority Data

Oct. 7, 2010 (JP) ..... 2010-227296

(51) Int. Cl.
*B65H 23/30* (2006.01)
*B21C 47/00* (2006.01)
*B21C 47/34* (2006.01)

(52) U.S. Cl.
CPC ..... *B21C 47/006* (2013.01); *B21C 47/3458* (2013.01)
USPC ..... 226/195; 226/172; 242/419.5; 242/419.8

(58) Field of Classification Search
CPC ..... B65H 23/105; B65H 23/12; B65H 2601/324; B65H 2601/61; B21C 47/003; B21C 47/006
USPC ..... 226/1, 170–173, 195, 196.1; 242/419, 242/419.5, 419.8, 548, 615; 198/626.1, 198/626.4, 626.5
See application file for complete search history.

(56) References Cited

U.S. PATENT DOCUMENTS

| | | | | | |
|---|---|---|---|---|---|
| 2,584,704 | A | * | 2/1952 | Horn | 164/440 |
| 3,481,523 | A | * | 12/1969 | Frank et al. | 226/172 |
| 3,735,937 | A | | 5/1973 | Plantard | |
| 5,265,817 | A | * | 11/1993 | Gaudin | 242/419.5 |
| 5,775,417 | A | * | 7/1998 | Council | 166/77.3 |
| 6,964,392 | B1 | * | 11/2005 | Matsunaga | 242/419.4 |
| 2004/0004148 | A1 | * | 1/2004 | Hashikawa | 242/419.8 |

FOREIGN PATENT DOCUMENTS

| | | |
|---|---|---|
| JP | 7-74061 B2 | 8/1995 |
| JP | 3769730 B2 | 2/2006 |
| JP | 3947714 B2 | 4/2007 |

* cited by examiner

*Primary Examiner* — William E Dondero
(74) *Attorney, Agent, or Firm* — Sughrue Mion, PLLC

(57) ABSTRACT

In a multiple endless belt type band sheet coiling tension applying apparatus in which a coiling tension is applied to slit band sheets a by a frictional force generated by slippage between belt pressing surfaces 4*a*, 5*a* and internal belt surfaces 1*a* of endless belts 1, a friction plate 8 made of a thin metallic sheet having heat conductivity equal to or better than that of the belt pressing units 4*a*, 5*a* is detachably installed on a front surface of each of the belt pressing units 4*a*, 5*a*.

5 Claims, 9 Drawing Sheets

MULTIPLE ENDLESS BELT TYPE BAND SHEET COILING TENSION APPLYING APPARATUS

BACKGROUND

1. Field of the Invention

The present invention relates to a technique which is used in a slitting line in which a coil of wide metallic band sheet base material is continuously cut into a plurality of band sheets along a longitudinal direction of the band sheet base material for re-coiling. It relates particularly to a multiple endless belt type band sheet coiling tension applying apparatus for applying a proper and uniform coiling tension to all of multiple slit band sheets in a coiling operation after a band sheet base material is slit into band sheets.

2. Description of the Related Art

In any of Japanese Patent Nos. 7074061(B), 3769730(B) and 3947714 (B) and U.S. Pat. No. 3,735,937 which constitute the related art of a multiple endless belt type band sheet coiling tension applying apparatus of our company, a belt pressing portion is constructed so that in an upper belt pressing unit, a hollow space for cooling water is provided directly above the upper belt pressing unit, and in a lower belt pressing unit, an empty space for cooling water is provided directly below the lower belt pressing unit, and these empty spaces are constructed as a completely closed box which enables cooling water to be circulated by a pump provided outside. In addition, in coiling multiple slit band sheets which are made by slitting a wide metallic base material fed from a coil of metallic base material, in order to apply a uniform and proper tension to all the slit band sheets, vertical reinforcement plates are provided in the interior of each of the empty spaces having the box construction so as to minimize the deflection of the belt pressing units which hold the slit band sheets vertically there-between via endless belts, and the reinforcement plates each double as a heat dissipating plate adapted to be in contact with the cooling water in the empty spaces and have a strong construction.

In this multiple endless belt type band sheet coiling tension applying apparatus, the special endless belts, which are each configured as a laminated structure using different types of materials so that friction coefficients of front and back surfaces thereof differ, rotate with their external belt surface sides which have a large friction coefficient closely attached to the corresponding slit band sheets by frictional engagement and at the same time their internal belt surface sides in contact with a pressing surface of the belt pressing unit to generate a tension in the slit band sheets by a relative frictional resisting force there-between. Most of work done to generate the tension is transformed into frictional heat, which increases the temperature of the metallic pressing surface. Unless this frictional heat is removed with good efficiency, the temperature of the pressing surface is increased, whereby the endless belts, which are each the laminated structure made up of a synthetic fiber material and a synthetic resin based material, are damaged by heat and cannot be used any more. Therefore, this frictional heat needs to be removed continuously with good efficiency so as to suppress the increase in temperature of the pressing surface of the belt pressing unit.

In order to enable the continuous operation of the multiple endless belt type band sheet coiling tension applying apparatus by preventing the occurrence of such an overheated state which would damage the endless belts, the empty spaces directly above and below the upper and lower pressing surfaces are configured as cooling water chambers and the plurality of reinforcement plates which double as the heat dissipating plates are disposed in the interior portions of the cooling water chambers, so that cooling water is circulated therein to be in contact with the heat dissipating plates with good efficiency so as to remove continuously the frictional heat generated by sliding friction between the pressing surfaces of the belt pressing units and the internal belt surfaces of the endless belts.

As is seen from the related art, in order to attain the two objects of conducting the frictional heat generated in the pressing surfaces of the belt pressing units to the cooling water chambers with good efficiency and minimizing the deflection of the belt pressing units, it is a common practice that the belt pressing unit is constructed so that the pressing surface which contacts the internal belt surface of the endless belt and the cooling water chamber are integrated into the closed box. Namely, the frictional heat is generated in the internal belt surfaces of the upper and lower endless belts which are held by the upper and lower pressing units and the pressing surfaces of the upper and lower pressing units, and most of the frictional heat so generated moves to back sides of the pressing surfaces by the metallic pressing surfaces which have a higher thermal conductivity than that of the endless belts which are made of the synthetic resin base material and moves further to the cooling water which is in contact with the back sides of the pressing surfaces and the reinforcement plates which each double as the heat dissipating plate.

In conducting the frictional heat to the cooling water with as good efficiency as possible, making thinner a thickness defined between the front surface side of the pressing surface which contacts the endless belt and the back surface side of the pressing surface which contacts the cooling water exhibits better effectiveness. However, a sufficient strength is necessary to generate a uniform frictional force by applying a uniform surface contact pressure over the whole of the pressing surface of each of the upper and lower pressing units by minimizing the deflection thereof, or a thickness needs to be ensured which takes into consideration an abrasion margin for repairing the pressing surface when it wears due to friction, which will be described later. Thus, the pressing surface is designed so as to ensure as thin a thickness as possible which can satisfy these requirements. In the past, our company actually used a multiple endless belt type band sheet coiling tension applying apparatus in which the thickness defined a front surface side and a back surface side of a pressing surface was designed to be increased, and we had an experience that endless belts were overheated to be damaged when the apparatus was operated continuously on a hot day in summer. Thus, we have tried to design the thickness between the front surface side and the back surface side of the pressing surface to be thin since the occurrence of the trouble.

In addition, when this apparatus is used for a long period of time, the pressing surface which contacts the endless belt which runs frictionally receives pressure and hence gradually wears, and irregularities produced on the pressing surface become intense. This causes the multiple slit band sheets to snake or the tension to be applied unevenly, resulting in a failure to coil the slit band sheets produced properly. Thus, as this occurs, the whole structure of the pressing unit including the cooling water chamber which is integrated with the pressing surface has to be replaced. However, the heat dissipating plates which cool the heat from the pressing surface with good efficiency are provided in the cooling water chamber. The pressing unit is made so rigid and strong as not to deflect so as to transmit the pressing force uniformly to the multiple slit band sheets via the endless belts. The pressing surface is finished with a uniform flat plane by elaborate machining, and complex and high-precision work such as wear resistant, hard chrome plating coating is applied to the pressing surface so as to extend the life thereof by reducing wear by the friction of the endless belts. Thus, the replacement of the pressing unit as a whole involves great expense. In addition, the replacement involving disassembling the whole apparatus becomes complex work. Therefore, maintaining the apparatus in operable conditions requires time and labor, constituting the problem that the user has to solve in terms of time and money.

When the wear loss on the pressing surface is small and the irregularities thereon are relatively small, the pressing unit is removed so that the pressing surface is abraded and is finished with hard chrome plating at a shop dedicated to such repair work. Thereafter, the pressing unit is reassembled to the apparatus for use. However, although this repair work involves a relatively large number of days, the slitting line has to be kept operating, and to make this happen, the user is forced to fabricate a whole pressing unit structure as an extra unit structure at great expense for replacement and to repair the worn pressing unit so as to store it as an extra replacement part.

The high degree of flat plane finishing and the hard chrome plating coating are applied to the frictional surface on the front surface of the pressing surface so as to generate a predetermined frictional force by pressing the endless belts uniformly. However, the friction coefficient of the frictional surface which is dry against the internal surfaces of the endless belts becomes unstable, and the tension applied to the slit band sheets via the endless belts is not stabilized. In addition, since the friction coefficient of the dried frictional surface on the front surface of the pressing surface becomes too large, a required difference in friction coefficient between the external belt surface and the internal belt surface of the endless belt cannot be ensured, and the endless belt cannot rotate. Since this causes a fatal trouble of generating scuff marks on the front surfaces of the slit band sheets due to slippage thereof, lubrication of the frictional surface is inevitable. In the related art, a lubricant applying unit is separately disposed so as to cause a lubricant to adhere to the internal belt surfaces of the endless belts, so that the lubricant applying unit is designed to be brought into contact with the internal belt surfaces of the rotating endless belts at an intermediate position along the length thereof, whereby the frictional surface on the front surface of the pressing surface is kept lubricated.

However, since the lubricant component adheres to grooves of pulleys or outer circumferences of oval drums with which the internal belt surfaces of the endless belts are in contact, insufficient lubrication or uneven lubrication occurs on the frictional surface on the front surface of the pressing surface that should be lubricated sufficiently or properly, and in the slitter line where the multiple endless belt type band sheet coiling tension applying apparatus is operated continuously under high load, the front surfaces of the pressing surfaces are overheated, which causes serious the problem that the endless belts are damage, that scuff marks are produced on or dirt adheres to the surfaces of the split band sheets due to the slippage of the endless belts or that the tension cannot be applied uniformly to thereby cause a failure to wind the slit band sheets into a coil. To avoid this problem as much as possible, the slitting line is stopped frequently even during the slitting operation so as to refill lubricant, this leading to a reduction in productivity.

Patent Document 1: Japanese Patent No. 7074061 (B)

Patent Document 2: Japanese Patent No. 3769730 (B)

Patent Document 3: Japanese Patent No. 3947714 (B)

Patent Document 4: U.S. Pat. No. 3,735,937

Since the multiple endless belt type band sheet coiling tension applying apparatus makes use of the friction resisting force between the pressing surfaces of the pressing units and the internal belt surfaces of the endless belts, the wear-resistant hard chrome plating coating is applied to the frictional surfaces on the front surfaces of the pressing surfaces on which the endless belts which are pressed by the upper and lower pressing unit structures so as to extend the lives of the pressing surfaces. However, as has been described above, when the apparatus is used for a long period of time, a wear phenomenon is caused gradually on the frictional surfaces which should be the flat plane to thereby produce irregularities on the frictional surfaces, resulting in unbalanced wear, whereby there is caused a problem that coils of slit band sheets are snaking or the coiling tension is applied unevenly to the multiple slit band sheets. Although the pressing units need to be replaced when the irregularities produced on the frictional surfaces by the wearing thereof grow, as has been described above, the pressing unit is integrated with the cooling water chamber designed to remove the frictional heat to form the complex and strong structure and is precision finished to obtain the uniform surface contact pressure. Thus, depending upon the size of the apparatus, the pressing unit constitutes a replacement part of 1 million yen or more per unit. The replacement work of the integrated pressing unit involves a large scale of work to be actually done for replacement in addition to expense, and the equipment involved in production needs to be put to rest during the replacement of pressing units, disturbing the productivity (the highly expensive replacement part and the large scale of replacement work).

General slitter lines are classified as, for example, a 3-feet (900 mm) type, a 4-feet (1200 mm) type, a 5-feet (1500 mm) type and a 6-feet (1800 mm) type depending upon maximum widths of coils of metallic materials (band sheets) which are handled therein, and in recent years, a slitter line with a maximum width of 2000 mm or larger comes to be used. Although a slitter line is prepared to match an expected maximum coil (band sheet) width, since in many cases most of coils (band sheets) that are slit and fed out from the slitter line are narrower in width than the expected maximum coil width, in the multiple endless belt type band sheet coiling tension applying apparatus, a portion of the pressing surface which lies around a central portion thereof and which is used most wears intensely, whereas portions of the pressing surface which lie on both sides thereof and which are not used frequently wear less. Even in the case of such unbalanced wear, with the pressing unit structure which is configured as the integral unit, the whole of the pressing unit structure needs to be replaced even when minute irregularities are produced by partial wear (even such minute wear requires the replacement of the whole of the pressing unit).

In order to enable the high-speed continuous operation by stabilizing the frictional resistance between the pressing units and the endless belts, the lubrication of the frictional surfaces on the front surfaces of the pressing surfaces becomes important, and to make this happen, the configuration is devised in which the special lubricant is brought into contact with the internal belt surfaces of the endless belts. However, since the lubricant contains lubricating oil and fat which tend to flow out under high temperatures caused by the frictional heat, the lubricating oil contents in the internal surface of the endless belt flow out to the external surface of the endless belt for dispersion from both side edge portions of the endless belt during the rotation of the endless belt by virtue of centrifugal force, as a result of which the lubricating oil contents come to adhere to the surface of the slit band sheet which is in contact with the external belt surface to thereby make dirty the high-grade surface finished slit band sheet, and when this occurs particularly on a surface painted coil or a high-grade plating finished coil (band sheet), the worst case results. In addition, when this lubricating oil contents run out during the operation of the slitter line, the internal belt surface of the endless belt is overheated to be damaged. Therefore, even in the midst of coiling the slit band sheets, the coiling operation needs to be stopped so that lubricant is refilled or the edge portions of the endless belt are cleaned so as to remove extra lubricating oil contents which flow out there-from. As a countermeasure there-against, the realization of a multiple endless belt type band sheet coiling tension applying apparatus is eagerly desired which can maintain a constant lubricated state without using liquid lubricating oil and fat (external lubrication which is characteristic of troublesome maintenance and inspection).

SUMMARY

This invention is made in view of the problems and with a view to solving the problems, and an object thereof is to provide a multiple endless belt type band sheet coiling tension applying apparatus which can obviate the necessity of abrasion work or large scale replacement work of belt pressing units or oval pressure applying members which results from wear of belt pressing surfaces of those units by attaching a friction plate of a thin metallic sheet to the easily wearable belt pressing surfaces of the belt pressing units or the oval pressure applying members so as to prevent the wear of the belt pressing surfaces.

With a view to attaining the object, according to a first aspect of the invention, there is provided a multiple endless belt type band sheet coiling tension applying apparatus in which a plurality of pairs of upper and lower endless belts which hold individually multiple slit band sheets from upper and lower surfaces thereof are provided in parallel in a widthwise direction of the slit band sheets, belt pressing units or oval pressure applying members which press internal belt surfaces of the upper and lower endless belts towards upper and lower surfaces of the slit band sheets, respectively, and which have cooling water chambers for cooling frictional heat generated in belt pressing surfaces in interiors thereof are disposed individually inside the upper and lower endless belts, a friction coefficient of an external belt surface of each of the upper and lower endless belts is made larger than a friction coefficient of the internal belt surface of each of the same endless belts so that the individual endless belts are driven by close engagement with the individual slit band sheets which move to a coiling side so as to cause the individual endless belts to circulate independently together with the individual slit band sheets which are moving, and a coiling tension is applied individually to the slit band sheets by a frictional force resulting from slippage occurring between the belt pressing surfaces and the internal belt surfaces of the endless belts, wherein a friction plate made up of a thin metallic sheet having a heat conductivity which is equal to or larger than that of the belt pressing units or the oval pressure applying members is detachably attached to front surfaces of the belt pressing surfaces of the belt pressing units or the oval pressure applying member.

In addition, as a preferred form according to the first aspect of the invention, there is provided a multiple endless belt type band sheet coiling tension applying apparatus as set forth in the first aspect, wherein the friction plate is divided into a plurality of friction plates whose width matches the width of the individual endless belts and which are arranged so as to correspond individually to the endless belts. Additionally, a thin coating having a self lubricating component is formed on a front surface side of each of the friction plates.

According to the invention configured so as to solve the problem, the friction plate approach in which the thin metallic sheet is disposed so as to be superposed on either of the belt pressing surfaces has the following advantages.

Since the friction plate is made of the thin metallic sheet and has the heat conductivity which is equal to or better than that of the material of the belt pressing units or the oval pressure applying members, even though the friction plate is disposed so as to be superposed on the belt pressing units or the oval pressure applying members, the heat conduction is implemented quickly and therefore, the cooling effect is not reduced.

Since the friction plate is the thin metallic sheet, the friction plate can easily be shear cut or press bent, thereby making it possible to realize an inexpensive part.

Since the friction plate is made of the thin metallic sheet, the internal belt surface can easily be introduced into and fed out from the holding portion in a smooth fashion by bending both edge portions of the friction plate, the friction plate constitutes an endless belt damage prevention measure.

Although the belt pressing units or the oval pressure applying members have the conventional steel construction due to the necessity of minimizing the deflection strength thereof and the viewpoint of weldability of the closed box construction for cooling water, a JIS cold-rolled steel sheet or copper or copper alloy sheet or cold-rolled thin sheet such as an aluminum sheet can freely be selected as a material for the friction plate from marketed inexpensive materials, and these proposed sheet materials have heat conductivity equal to or better than that of the material of the belt pressing units or the oval pressure applying members.

In addition, in the event that a fluorine plastic coated steel sheet or a thin metallic sheet coated with a sintered layer of a self lubricating component such as molybdenum or graphite is used, the necessity of an external supply of lubricant is obviated, and therefore, no lubricant or lubricating material applying unit is necessary, and the maintenance and inspection of the apparatus is facilitated very much.

Since the approach is used in which the thin metallic sheet is superposed on the belt pressing surface, the friction plate can be divided into friction plates whose width corresponds to the width of the endless belts. This enables a partial replacement of endless belts which get worn seriously, and therefore, the expense for maintenance and control of the apparatus is reduced, and the replacement of endless belts can be implemented within a short period of time, leading to an increase in productivity.

Irrespective of sizes of tension applying apparatus, the divided friction plates which are made of the thin metallic sheet are stocked as small and light common standard parts, and therefore, and the friction plates can be supplied to users of all over the world for convenience.

The friction plate is epoch-making in that an easily replaceable friction surface can be realized without reducing the strength and thermal efficiency by disposing the friction plate of the thin metallic sheet so as to be superposed on the belt pressing surface in the way described above. When the friction surface wears, only friction plates that get worn can easily be replaced with friction plates which are prepared within a short period of time, whereby the maintenance and control of the apparatus can be implemented easily and quickly without disturbing the production activities.

In addition, since the thin metallic sheet which can easily be bent by a press only has to be superposed on the belt pressing units or the oval pressure applying members for replacement, the friction plate constitutes a very inexpensive replacement part. Alternatively, when one side of the friction plate is coated with the fluorine plastic coated steel sheet or the sintered layer of molybdenum or graphite, the self lubricating function can be imparted to the side of the friction plate, whereby the pressed friction surface and the internal belt surface are lubricated sufficiently and uniformly to thereby solve the problems of the snaking of the slit band sheets and the unbalanced applying of tension thereto. In case the conventional external lubricant applying unit is made unnecessary, the inspection and refilling of lubricant is also made unnecessary which would otherwise be implemented in the midst of the slitting operation by stopping the operation of the slitting line. Thus, the productivity is increased remarkably.

Additionally, since the approach taken by the invention is not the approach in which the lubricating oil and fat are applied to the internal belt surface, there is caused no such situation that oil and fat contents adhere to the belt, as a result of which the surface of the slit band sheet does not get dirty and is prevented from losing the qualification as a product, this serving much to increase the yielding and quality of slit band sheets produced.

In addition, the friction plate can be divided into friction plates each having a width corresponding to the width of the single endless belt or corresponding to widths resulting from adding up the widths of a plurality of endless belts. By adopting this approach, the initial performance of the apparatus can be recovered and maintained by replacing only friction plates at the portion of the friction surface which wears early, and therefore, the maintenance and control of the apparatus can be implemented easily and quickly at very inexpensive maintenance costs. Thus, the multiple endless belt type band sheet coiling tension applying apparatus of the invention can provide the extremely novel and useful advantages.

BRIEF DESCRIPTION OF THE DRAWINGS

FIGS. 3(A) to 3(C) are partial side sectional views showing modified examples of a portion A lying at an edge portion side of a friction plate shown in FIG. 2, in which FIG. 3(A) is a partial side sectional view showing fixing employing an adhesive, FIG. 3(B) is a partial side sectional view showing fixing employing groove fitting, and FIG. 3(C) is a partial side sectional view showing fixing employing screws.

FIGS. 8(A) to 8(C) are partial side sectional views showing modified examples of a portion A lying at an edge portion side of a friction plate shown in FIG. 7, in which FIG. 8(A) is a partial side sectional view showing fixing employing an adhesive, FIG. 8(B) is a partial side sectional view showing fixing employing groove fitting, and FIG. 8(C) is a partial side sectional view showing fixing employing screws.

FIGS. 9(A) to 9(D) are explanatory drawings explaining the fixing employing groove fitting at the portion A lying at the edge portion side of the friction plate shown in FIG. 7, in which FIG. 9(A) is a partial side sectional view of the edge portion side of the friction plate, FIG. 9(B) is a partially enlarged side sectional view of a distal end portion of the friction plate at a portion B in FIG. 9(A), FIG. 9(C) is a partially enlarged side sectional view of an engagement groove at the portion B in FIG. 9(A), and FIG. 9(D) is a partially enlarged side sectional view of the distal end portion of the friction plate which is installed in the engagement groove at the portion B in FIG. 9(A).

DETAILED DESCRIPTION

Figure 1:
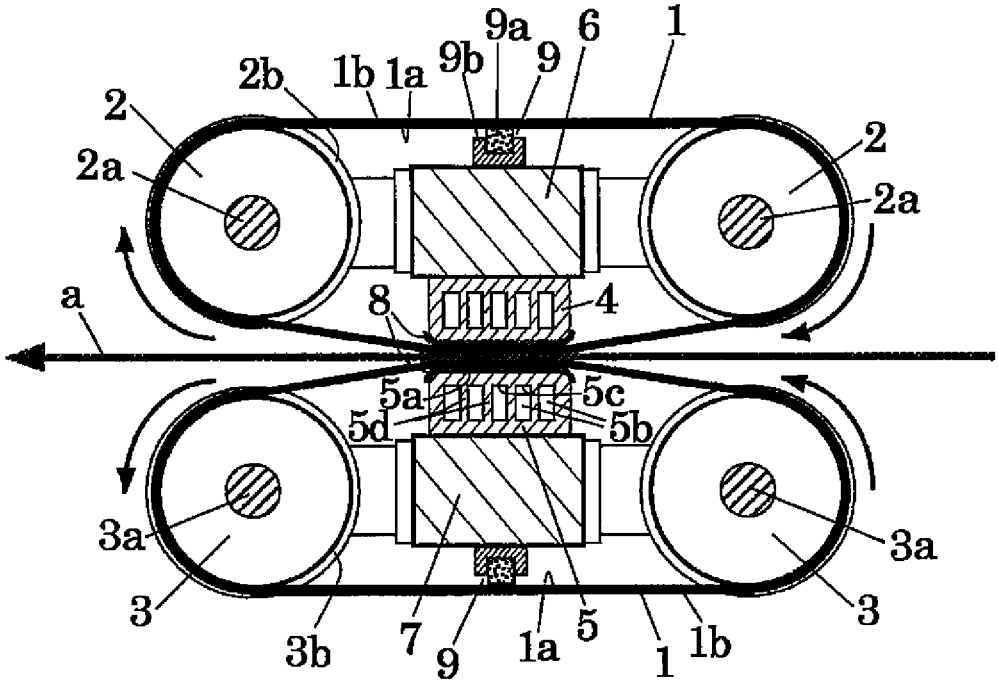
FIG. 1 is a side sectional view of a multiple endless belt type band sheet coiling tension applying apparatus employing pulleys which shows Embodiment 1 for carrying out the invention.
Figure 2:
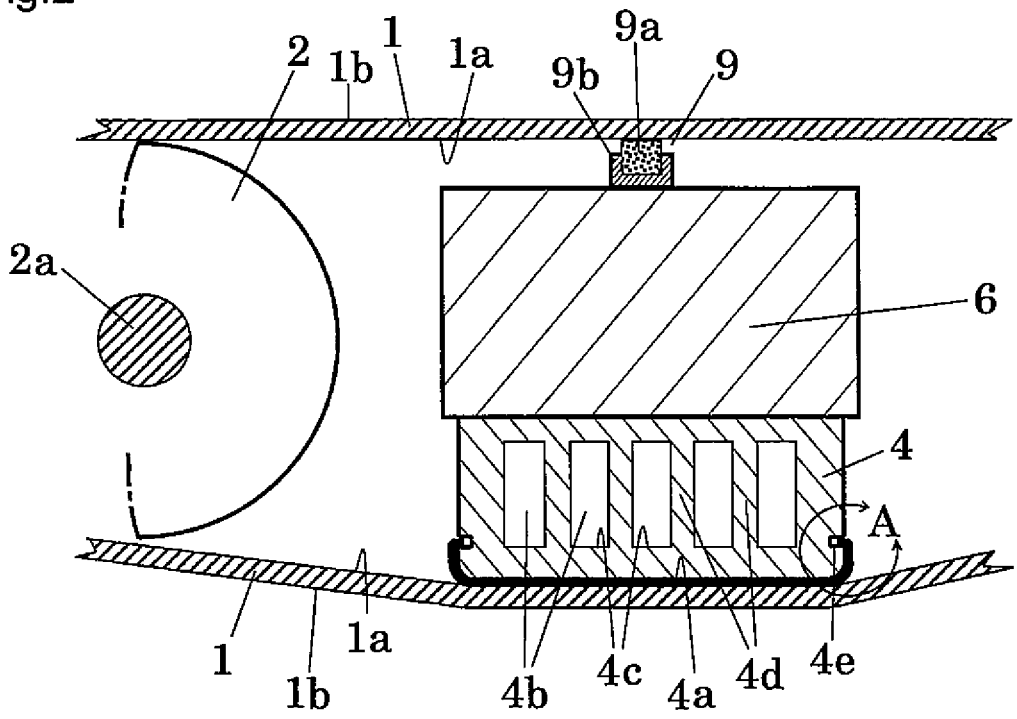
FIG. 2 is a partially enlarged side sectional view of the multiple endless belt type band sheet coiling tension applying apparatus employing pulleys which shows Embodiment 1 for carrying out the invention.

Hereinafter, the invention will be described more specifically based on embodiments for carrying out the invention which are depicted on the drawings.

Since there are two types of multiple endless belt type band sheet coiling tension applying apparatus; one apparatus employs pulleys and the other apparatus is free from pulleys and employs oval drums, the apparatus employing the pulleys will be described in Embodiment 1, and the apparatus employing the oval drums will be described in Embodiment 2.

(Embodiment 1)

In FIGS. 1 to 3 and 10 to 12, a multiple endless belt type band sheet coiling tension applying apparatus employing pulleys is a apparatus for applying a predetermined coiling tension to slit band sheets a which are coiled around a slit band sheet coiling apparatus, not shown, and is disposed in an intermediate position along the length of a moving passage for slit band sheets a which lies before the slit band sheet coiling apparatus, not shown.

The multiple endless belt type band sheet coiling tension applying apparatus employing pulleys includes mainly a plurality of endless belts 1 which are each stretched into a substantially oval shape so as to circulate continuously and which are arranged to face each other vertically while being arranged side by side in a widthwise direction, pairs of upper pulleys 2 and pairs of lower pulleys 3 around which the upper endless belts 1 and the lower endless belts 1 are stretched into the substantially oval shape, respectively, so as to move there-around continuously, a pair of belt pressing units or an upper belt pressing unit 4 and a lower belt pressing unit 5 which press directly and individually internal belt surfaces 1*a* of the upper and lower endless belts 1, respectively, and an upper pressure applying member 6 and a lower pressure applying member 7 which apply a pressure to the belt pressing units 4, 5, respectively, so as to press the belt pressing units 4, 5 towards the internal belt surfaces 1*a* of the upper and lower endless belts 1, respectively. The upper pairs of pulleys 2 and the lower pairs of pulleys 3 and the upper and lower pressure applying members 6, 7 are supported on stands, not shown, and the applying of pressure by the pressure applying members 6, 7 is implemented by hydraulic cylinders, not shown as well.

The upper pressure applying member 6 presses downwards the plurality of endless belts 1 which are disposed side by side on the upper side via the upper belt pressing unit 4, while the lower pressure applying member 7 presses upwards the plurality of endless belts 1 which are disposed side by side on the lower side via the lower belt pressing unit 5 by making use of reaction force. The upper pressure applying member 6 and the lower pressure applying member 7 cooperate with each other so as to hold indirectly slit band sheets a which pass between the upper and lower endless belts 1 which face each other vertically via the upper and lower endless belts 1 from above and below the slit band sheets a under the same pressure to thereby apply a predetermined coiling tension to the slit band sheets a which are wound around the slit band sheet coiling apparatus, not shown.

The endless belt 1 is disposed so as to circulate continuously in a traveling direction of the slit band sheets a, and the plurality of endless belts 1 are disposed side by side in the transverse direction, that is, the direction which intersects the traveling direction of the slit band sheets a. Further, the plurality of endless belts 1 which are so arranged are disposed so as to face vertically the plurality of endless belts 1 which are arranged in the same way.

The endless belts 1 which are disposed so as to face each other vertically while being arranged side by side in the transverse direction are each made up of an endless belt. The endless belts 1 are stretched into the substantially oval shape between the upper pairs of pulleys 2 which are disposed on the upper side and between the lower pairs of pulleys 3 which are disposed on the lower side so as to move there-around independently. Each endless belt 1 is installed so as to circulate independently in the traveling direction of the corresponding slit band sheet a.

An external belt surface 1*b* of the endless belt 1 is joined to the corresponding slit band sheet a and functions to move the slit strap a. In contrast to this, the internal belt surface 1*a* of the endless belt 1 functions to generate a coiling tension in the slit band sheet a by a frictional force generated by slippage between itself and a belt pressing surface 4*a* of the upper belt pressing unit 4 pressed by the upper pressure applying member 6 or a pressing surface 5*a* of the lower belt pressing unit 5 pressed by the lower pressure applying member 7. Because of this, the internal belt surface 1*a* has a smaller friction coefficient than that of the external belt surface 1*b* of the endless belt 1 so that the internal belt surface 1*a* becomes easy to slip.

The internal belt surface 1*a* of the endless belt 1 is formed of a woven fabric of synthetic fibers so that a lubricant soaks between interwoven fibers and recessed interstices of the woven fabric, and a flexible material having a high friction coefficient is laminated on the external belt surface 1*b* of the endless belt 1.

By employing the woven fabric as the internal belt surface 1*a* of the endless belt 1, the lubricant is allowed to soak between the interwoven fibers and into the recessed interstices of the woven fabric in advance so as to reduce the friction coefficient of the internal belt surface 1*a* of the endless belt 1. In addition, since the woven fabric differs from a solid plate-like material and is characterized by large flexibility, the rotational resistance of the endless belt 1 which is pressed by the upper belt pressing unit 4 or the lower belt pressing unit 5 is small. Synthetic fiber materials such as polyester, Vinylon and nylon can be used for the woven fabric.

The external belt surface 1*b* of the endless belt 1 is formed of a material having a larger friction coefficient than that of the internal belt surface 1*a* of the endless belt 1. Namely, a wear-resistant material, for example, a soft synthetic resin fibrous material having a low friction coefficient is used as an internal belt surface material of the endless belt 1, and an elastic element having a high friction coefficient, for example, a rubber or synthetic resin sheet material is laminated as an external surface material.

The pair of upper pulleys 2 is disposed to be situated at a front and rear sides of the upper pressure applying member 6 so as to hold it there-between. Pulley shafts 2*a* are disposed at the front and rear sides of the upper pressure applying member 6 so as to extend in the widthwise direction of the endless belts 1 provided side by side, and the plurality of upper pulleys 2 are supported on each of the front and rear pulley shafts 2*a* so as to rotate independently of one another. Ends of the front pulley shaft 2*a* are connected to and supported at ends on a front side of the upper pressure applying member 6, and ends of the rear pulley shaft 2*a* are connected to and supported at ends of a rear side of the upper pressure applying member 6.

The endless belts 1 which are disposed above the slit band sheets a are stretched between the upper pulleys 2 which are supported rotatably on the pulley shafts 2*a* disposed at the front and rear sides of the upper pressure applying member 6. Namely, the upper pulleys 2 are supported rotatably so as to rotate independently of one another towards a traveling direction of the slit band sheets a, whereby the endless belts 1 can circulate independently of one another in the traveling direction of the slit band sheets a.

Each of the pair of upper pulleys 2 has a circular shape, and a groove-type guide collar 2*b* is formed on a circumferential edge portion of the upper pulley 2. Each endless belt 1 is guided by this groove-type guide collar 2*b* along side edge portions thereof to thereby be prevented from being brought into contact with the adjacent endless belts 1. Although not shown, ball bearings or separation holding rings are installed on each of the pulley shafts 2*a* which are disposed at the front and rear sides of the upper pressure applying member 6 so as to be disposed individually between the adjacent upper pulleys 2 which are supported rotatably on the pulley shaft 2*a*, so that the upper pulleys 2 are prevented from being shifted in the widthwise direction of the endless belts 1.

Each of the pair of upper pulleys 2 around which the endless belt 1 is stretched is supported idly rotatably on each of the pulley shafts 2*a* disposed at the front and rear sides of the upper pressure applying member 6. A drive source for causing the endless belt 1 to circulate is not provided on each upper pulley 2, and therefore, the endless belt 1 moves around only through a frictional engagement with the moving slit band sheet a and hence does not circulate by itself. Namely, the endless belts 1 which are stretched between the pairs of upper pulleys 2 do not circulate unless the endless belts 1 are brought into contact with the slit band sheets a.

The upper pressure applying member 6 is placed so as to extend through the internal sides of the multiplicity of endless belts 1 which are disposed above the slit band sheets a. The upper belt pressing unit 4 is placed at a lower side of the upper pressure applying member 6 which is placed in the state described above, and the upper belt pressing unit 4 is also placed so as to extend through the internal sides of the multiplicity of endless belts 1. The upper belt pressing unit 4 is constructed of steel from the viewpoints of necessity of minimizing the deflection strength and weldability of a closed box construction for cooling water.

The belt pressing surface 4*a* is formed into a horizontal straight line in the side sectional view of the apparatus in FIG. 1 so as to press the internal belt surfaces 1*a* of the endless belts 1. The upper belt pressing unit 4 and the upper pressure applying member 6 are placed so that their longitudinal directions intersect the traveling direction of the slit band sheets a at right angles and extend through the internal sides of the upper endless belts 1.

A cooling water chamber 4*b* is provided in an interior of the upper belt pressing unit 4 having the belt pressing surface 4*a* on a lower surface thereof, and this cooling water chamber 4*b* traverses the endless belts 1. Water is designed to flow into the cooling water chamber 4*b* for cooling, whereby the cooling water chamber 4*b* prevents the overheat of the endless belts 1 which are pressed by the upper belt pressing unit 4 via the belt pressing surface 4*a* by friction heat. Namely, the endless belts 1 are prevented from being overheated by allowing friction heat generated to escape to the cooling water chamber 4*b* through the belt pressing surface 4*a*.

As has been described before, a thickness defined between the belt pressing surface 4*a* and a back surface side 4*c* of the belt pressing surface which constitutes a bottom surface side of the cooling water chamber 4*b* which contacts cooling water is made as thin as possible while bearing the pressing force in order to conduct the friction heat to the cooling water in the cooling water chamber 4*b* as efficiently as possible.

The interior of the cooling water chamber 4*b* is reinforced and partitioned by reinforcement plates 4*d*. The reinforcement plates 4*d* also function as heat dissipating plates which dissipate heat conducted thereto from a friction plate 8 via the belt pressing surface 4*a* to the interior of the cooling water chamber 4*b*. The reinforcement plates 4*d* which reinforce the cooling water chamber 4*b* defined in the interior of the upper belt pressing unit 4 function to retain the shape of the upper belt pressing unit 4 whose interior becomes hollow due to the formation of the cooling water chamber 4*b*. Namely, although compression forces act on the upper belt pressing unit 4 which presses the endless belts 1 downwards from above and below, the reinforcement plates 4*d* function to resist the compression forces to thereby prevent the upper belt pressing unit 4 from being deflected or curved in the longitudinal direction.

As has been described above, the belt pressing surface 4*a* on the lower surface of the upper belt pressing unit 4 wears gradually, and irregularities produced thereon grow intensely, whereby the multiplicity of slit band sheets a snake or the coiling tension applied thereto becomes uneven, leading to a failure of coiling the split band sheets a into a coil as a product. Then, the friction plate 8 is detachably installed on a front surface of the belt pressing surface 4*a*.

The pair of lower pulleys 3 is disposed to be situated at a front and rear sides of the lower pressure applying member 7 so as to hold it there-between. Pulley shafts 3*a* are disposed at the front and rear sides of the lower pressure applying member 7 so as to extend in the widthwise direction of the endless belts 1 provided side by side, and the plurality of lower pulleys 3 are supported on each of the front and rear pulley shafts 3*a* so as to rotate independently of one another. Ends of the front pulley shaft 3*a* are connected to and supported at ends on a front side of the lower pressure applying member 7, and ends of the rear pulley shaft 3*a* are connected to and supported at ends of a rear side of the lower pressure applying member 7.

The endless belts 1 which are disposed below the slit band sheets a are stretched between the lower pulleys 3 which are supported rotatably on the pulley shafts 3*a* disposed at the front and rear sides of the lower pressure applying member 7. Namely, the lower pulleys 3 are supported rotatably so as to rotate independently of one another towards a traveling direction of the slit band sheets a, whereby the endless belts 1 can circulate independently of one another in the traveling direction of the slit band sheets a.

Each of the pair of lower pulleys 3 has a circular shape, and a groove-type guide collar 3*b* is formed on a circumferential edge portion of the lower pulley 3. Each endless belt 1 is guided by this groove-type guide collar 3*b* along side edge portions thereof to thereby be prevented from being brought into contact with the adjacent endless belts 1. Although not shown, ball bearings or separation holding rings are installed on each of the pulley shafts 3*a* which are disposed at the front and rear sides of the lower pressure applying member 7 so as to be disposed individually between the adjacent lower pulleys 3 which are supported rotatably on the pulley shaft 3*a*, so that the lower pulleys 3 are prevented from being shifted in the widthwise direction of the endless belts 1.

Each of the pair of lower pulleys 3 around which the endless belt 1 is stretched is supported idly rotatably on each of the pulley shafts 3*a* disposed at the front and rear sides of the lower pressure applying member 7. A drive source for causing the endless belt 1 to circulate is not provided on each lower pulley 3, and therefore, the endless belt 1 moves around only through a frictional engagement with the moving slit band sheet a and hence does not circulate by itself. Namely, the endless belts 1 which are stretched between the pairs of lower pulleys 3 do not circulate unless the endless belts 1 are brought into contact with the slit band sheets a.

The lower pressure applying member 7 is placed so as to extend through the internal sides of the multiplicity of endless belts 1 which are disposed below the slit band sheets a. The lower belt pressing unit 5 is placed at an upper side of the lower pressure applying member 7 which is placed in the state described above, and the lower belt pressing unit 5 is also placed so as to extend through the internal sides of the multiplicity of endless belts 1. The lower belt pressing unit 5 is constructed of steel from the viewpoints of necessity of minimizing the deflection strength and weldability of a closed box construction for cooling water.

The belt pressing surface 5*a* is formed into a horizontal straight line in the side sectional view of the apparatus in FIG. 1 so as to press the internal belt surfaces 1*a* of the endless belts 1. The lower belt pressing unit 5 and the lower pressure applying member 7 are placed so that their longitudinal directions intersect the traveling direction of the slit band sheets a at right angles and extend through the internal sides of the upper endless belts 1.

A cooling water chamber 5*b* is provided in an interior of the lower belt pressing unit 5 having the belt pressing surface 5*a* on an upper surface thereof, and this cooling water chamber 5*b* traverses the endless belts 1. Water is designed to flow into the cooling water chamber 5*b* for cooling, whereby the cooling water chamber 5*b* prevents the overheat of the endless belts 1 which are pressed by the lower belt pressing unit 5 via the belt pressing surface 5*a* by friction heat. Namely, the endless belts 1 is prevented from being overheated by allowing friction heat generated to escape to the cooling water chamber 5*b* through the belt pressing surface 5*a*.

As has been described before, a thickness defined between the belt pressing surface 5*a* and a back surface side 5*c* of the belt pressing surface which constitutes a ceiling surface side of the cooling water chamber 5*b* which contacts cooling water is made as thin as possible while bearing the pressing force in order to conduct the friction heat to the cooling water in the cooling water chamber 5*b* as efficiently as possible.

The interior of the cooling water chamber 5*b* is reinforced and partitioned by reinforcement plates 5*d*. The reinforcement plates 5*d* also function as heat dissipating plates which dissipate heat conducted thereto from a friction plate 8 via the belt pressing surface 5*a* to the interior of the cooling water chamber 5*b*. The reinforcement plates 5*d* which reinforce the cooling water chamber 5*b* defined in the interior of the lower belt pressing unit 5 function to retain the shape of the lower belt pressing unit 5 whose interior becomes hollow due to the formation of the cooling water chamber 5*b*. Namely, although compression forces act on the lower belt pressing unit 5 which presses the endless belts 1 upwards from above and below, the reinforcement plates 5*d* function to resist the compression forces to thereby prevent the lower belt pressing unit 5 from being deflected or curved in the longitudinal direction.

As has been described above, the belt pressing surface 5*a* on the upper surface of the lower belt pressing unit 5 wears gradually, and irregularities produced thereon grow intensely, whereby the multiplicity of slit band sheets a snake or the coiling tension applied thereto becomes uneven, leading to a failure of coiling the split band sheets a into a coil as a product. Then, the friction plate 8 is detachably installed on a front surface of the belt pressing surface 5*a*.

The friction plates 8 are formed of a thin metallic sheet having heat conductivity equal to or better than those of the upper belt pressing unit 4 and the lower belt pressing unit 5 and are detachably installed on the front surfaces of the belt pressing surfaces 4*a*, 5*a* of the belt pressing units 4, 5. The friction plates 8 contact directly the internal belt surfaces 1*a* of the endless belts 1 in place of the upper and lower belt pressing surfaces 4*a*, 5*a* to function to prevent the direct wear of the respective belt pressing surfaces 4*a*, 5*a* which are configured as integral parts of the lower surface side of the upper belt pressing unit 4 and the upper surface side of the lower belt pressing unit 5.

Figure 3:
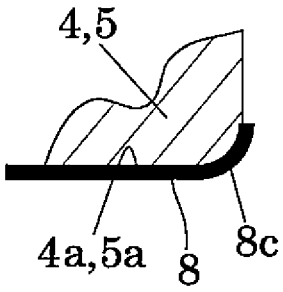
Figure 3:
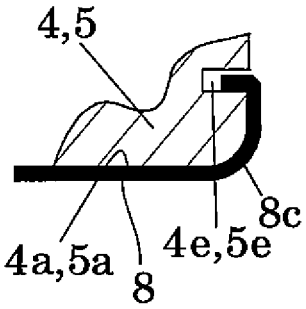
Figure 3:
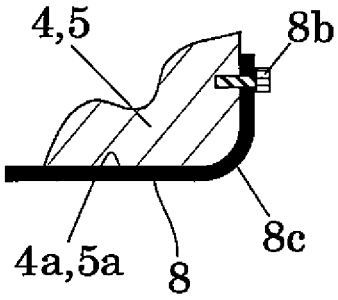
Figure 4:
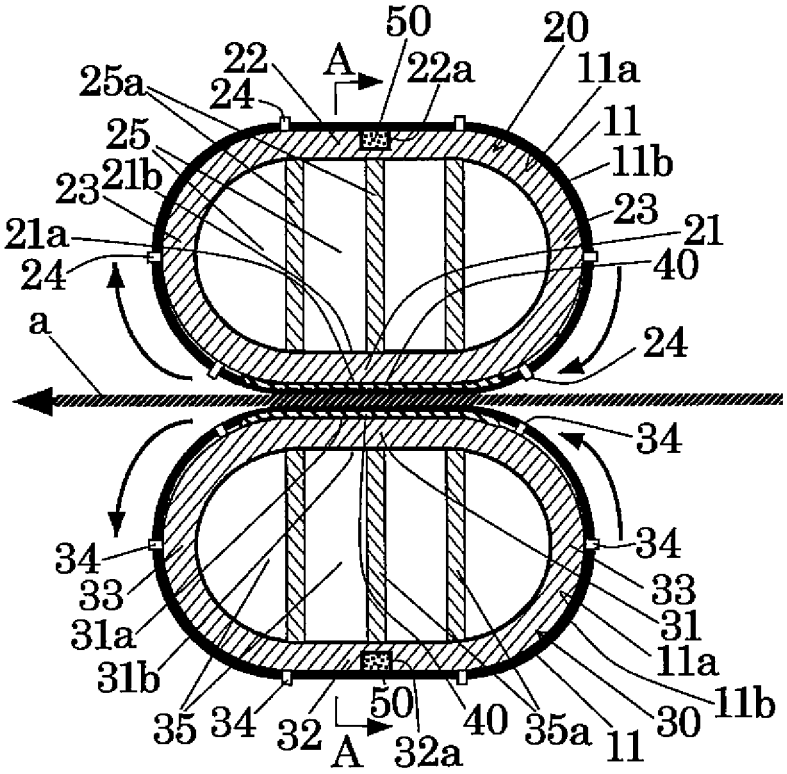
FIG. 4 is a side sectional view of a multiple endless belt type band sheet coiling tension applying apparatus employing oval drums which shows Embodiment 2 for carrying out the invention.
Figure 5:
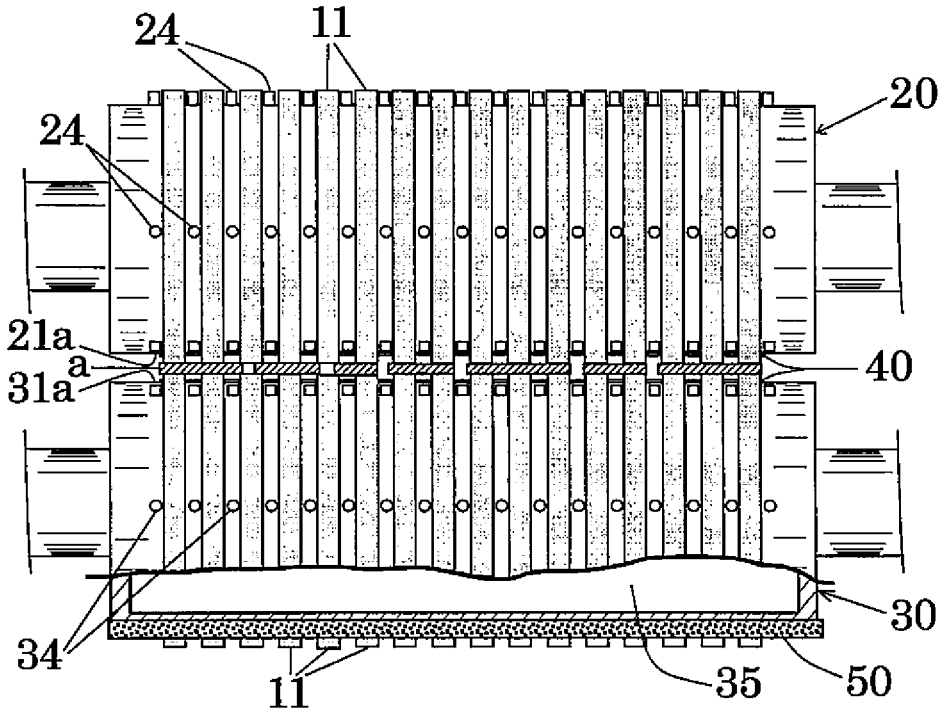
FIG. 5 is a partially cutaway front view of the multiple endless belt type band sheet coiling tension applying apparatus employing oval drums which shows Embodiment 2 for carrying out the invention.
Figure 6:
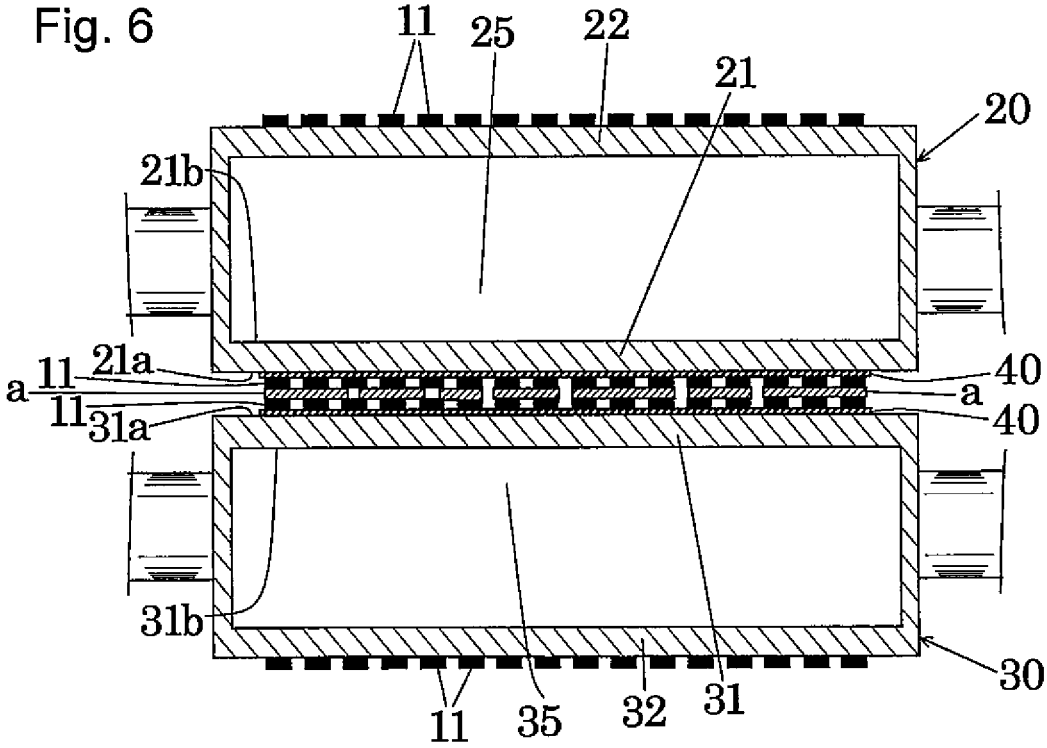
FIG. 6 is a sectional view, taken along the line A-A in FIG. 4, of the multiple endless belt type band sheet coiling tension applying apparatus employing oval drums which shows Embodiment 2 for carrying out the invention.
Figure 7:
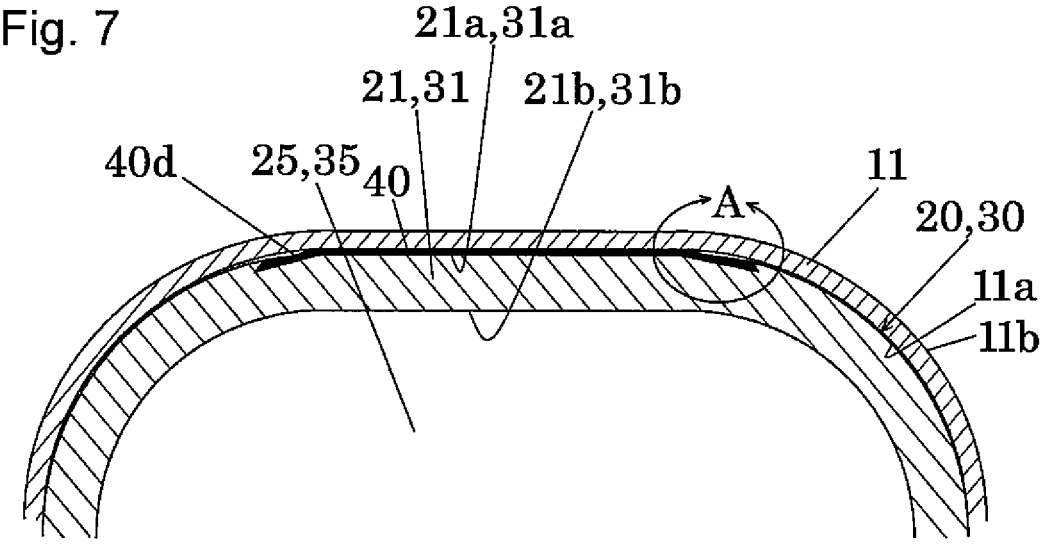
FIG. 7 is a partial side sectional view of the multiple endless belt type band sheet coiling tension applying apparatus employing oval drums which shows Embodiment 2 for carrying out the invention.

The friction plates 8 are installed so as to be closely attached to the front surfaces of the belt pressing surfaces 4*a*, 5*a*. Further, when pressed against the slit band sheets a, since the friction plates 8, formed of the thin metallic sheet, are strongly closely attached to the front surfaces of the belt pressing surfaces 4*a*, 5*a* by the pressing force, friction heat generated between the internal belt surfaces 1*a* of the endless belts 1 and the friction plates 8 is conducted smoothly from the friction plates 8 to the belt pressing surfaces 4*a*, 5*a* by the close attachment. In addition, as is shown in FIG. 3, the installation of the friction plates 8 on the front surfaces of the belt pressing surfaces 4*a*, 5*a* is implemented through, for example, fixing employing an adhesive (refer to FIG. 3(A)), fixing employing groove fitting (refer to FIG. 3(B)), or fixing employing screws (refer to FIG. 3(C)).

In the case of the fixing employing an adhesive (refer to FIG. 3(A)), although an adhesive is applied to either or both of the front surfaces of the belt pressing surfaces 4*a*, 5*a* and back surface sides which constitute adhesion sides of the friction plates 8, an adhesive which does not disturb the heat conduction is used as the adhesive so applied. In addition, in the case of the fixing employing groove fitting (refer to FIG. 3(B)), engagement grooves 4*e*, 5*e* into which edge portions of the friction plates 8 are fitted are formed in lower side surfaces on the front and rear sides of the upper belt pressing unit 4 and upper side surfaces on the front and rear sides of the lower belt pressing unit 5 which correspond to the traveling direction of the slit band sheets a. When the friction plate 8 is installed on the upper belt pressing surface 4*a*, the horizontal side edge portions of the friction plate 8 are bent upwards, and leading ends of the side edge portions so bent are then bent inwards at right angles so as to be fitted in the corresponding engagement grooves 4*e*, whereby the friction plate 8 is installed on the upper belt pressing surface 4*a*. Similarly, when the friction plate 8 is installed on the lower belt pressing surface 5*a*, the horizontal side edge portions of the friction plate 8 are bent downwards, and leading ends of the side edge portions so bent are then bent inwards at right angles so as to be fitted in the corresponding engagement grooves 5*e*, whereby the friction plate 8 is installed on the lower belt pressing surface 5*a*. Further, in the case of the fixing employing screws (refer to FIG. 3(C)), the side edge portions of the friction plates 8 are bent and fixed with a screw 8*b* to the lower side surfaces on the front and rear sides of the upper belt pressing unit 4 and the upper side surfaces on the front and rear sides of the lower belt pressing unit 5 which correspond to the traveling direction of the slit band sheets a.

As a means for facilitating the maintenance and control of the belt pressing surfaces 4*a*, 5*a* of the belt pressing units 4, 5 with respect to unbalanced wear thereon without reducing the deflection strength of the upper and lower belt pressing units 4, 5 and reducing the heat conductivity which enables the conduction of friction heat to the cooling water chambers 4*b*, 5*b*, the friction plates 8 which are each formed of the thin metallic sheet which is several millimeters thick (for example, from 0.5 mm to approximately 2.5 mm) are disposed to be superposed on the friction surfaces on the front surfaces of the belt pressing surfaces 4*a*, 5*a*.

As was described in the previous paragraph of "Related Art," although the thickness defined between the belt pressing surface 4*a*, 5*a* and the back surface side 4*c*, 5*c* of the belt pressing surface which contacts the cooling water chamber 4*b*, 5*b* which contacts in turn cooling water in the cooling water chamber 4*b*, 5*b* is designed in consideration of heat conduction, deflection strength and abrasion margin (normally, up to approximately 3 mm) for wear, in order to enable a continuous operation of the apparatus without trouble resulting from the overheat of the endless belts 1, the thickness should be not more than the conventional thickness. Then, by paying attention to this abrasion margin, the idea has been reached that the abrasion margin is designed thinner than that of the conventional upper and lower belt pressing units 4, 5 and the friction plate 8 formed of the thin metallic sheet whose thickness corresponds to the reduced amount of abrasion margin is disposed to be superposed on each of the belt pressing surfaces 4*a*, 5*a*. In addition, the thickness of the friction plate 8 formed of the thin metallic sheet which is disposed to be so superposed should be limited to a range of 0.5 mm to approximately 2.5 mm in consideration of workability such as press bending and heat conduction loss of friction heat by the disposition of the friction plates 8 on the upper and lower belt pressing units 4, 5.

As a thin metallic sheet material used as the friction plate 8, it is possible to use, for example, JIS (JIS G 3141) cold-rolled steel sheet and steel band sheet, JIS (JIS H 3100) copper and copper alloy sheet or JIS (JIS H 4000) cold-rolled aluminum or aluminum alloy sheet, these metallic sheets having a good heat conductivity. However, in any case, a bright finished sheet material which is smooth finished by a rolling role which is finished smoothly is preferred, and a hard-finished quenched and tempered sheet material is preferred from the viewpoint of wear prevention. Of course, in this case, too, a lubricant applying unit 9, which will be described later, is provided as required, and a lubricant 9*a*, which will be described later, adhering to the internal belt surface 1*a* of the endless belt 1 lubricates the surface of the friction plate 8. However, when an uneven applying of coiling tension is caused due to gradual wear of the friction plate 8 resulting from the long use thereof, only the friction plate 8 formed of the thin metallic sheet which gets so worn can be removed for replacement.

The friction plate 8 is formed of the thin metallic sheet whose thickness is in the range of, for example, 0.5 mm to approximately 2.5 mm as has been described above, and a total thickness of the thickness defined between the lower surface side or the belt pressing surface 4*a* of the upper belt pressing unit 4 where friction heat is generated and the back surface side 4*c* of the belt pressing surface and the thickness of the friction plate 8 which is superposed on the belt pressing surface 4*a* is equal to or thinner than the thickness defined between the belt pressing surface 4*a* and the back surface side 4*c* of the conventional belt pressing unit 4. Similarly, a total thickness of the thickness defined between the upper surface side or the belt pressing surface 5*a* of the lower belt pressing unit 5 where friction heat is generated and the back surface side 5*c* of the belt pressing surface and the thickness of the friction plate 8 which is superposed on the belt pressing surface 5*a* is equal to or thinner than the thickness defined between the belt pressing surface 5*a* and the back surface side 5*c* of the conventional belt pressing unit 5.

The friction plates 8 of the thin metallic sheet, which are held and pressed by the upper and lower belt pressing units 4, 5 so as to generate a coiling tension by a friction force on the internal belt surfaces 1*a* of the endless belts 1, are easily closely attached to the front surfaces of the belt pressing surfaces 4*a*, 5*a*. Therefore, as with the conventional integrated construction, friction heat generated by the coiling operation of the slit band sheets a is conducted to the cooling water chambers 4*b*, 5*b* in the interiors of the belt pressing units 4, 5, and hence, there is caused no such situation that the cooling effect is reduced.

The design of this embodiment ensures a sufficient strength required to compensate for the reduction in thickness of the abrasion margins of the conventional belt pressing units 4, 5. In addition, the friction plates 8 formed of the thin metallic sheet are superposed on the front surfaces of the similar pressing unit box-shaped constructions to those of the conventional belt pressing units 4, 5, and hence, there is also caused no such situation that the rigidity and strength of the belt pressing units 4, 5 are insufficient.

Then, when the front surfaces of the friction plates 8 which contact directly the internal belt surfaces 1*a* of the endless belts 1 wear, the overall structures of the complex and expensive pressing units 4, 5 which are integrated with the cooling water chambers 4*b*, 5*b* do not have to be replaced but only the friction plates 8 of the thin metallic sheet have to be removed for replacement. Moreover, the maintenance and control of this apparatus can be implemented by a quick and simple operation.

Incidentally, although the upper and lower endless belts 1 rotate continuously by being pulled by the slit band sheets a while being pressed and held by the upper and lower belt pressing units 4, 5, corners of the belt pressing units 4, 5 on ingress and egress sides need to be rounded for fear that the internal belt surfaces 1*a* are damaged by the corner portions of the belt pressing units 4, 5. As this occurs, since the friction plate 8 formed of the thin metallic sheet which is only several millimeter thick can be press bent easily, rounded corner portions 8*c* can be provided on both sides of the friction plate 8 so as to prevent the damage of the internal belt surfaces 1*a*.

In addition, the friction plate 8 is made of the material which has heat conductivity equal to or better than those of the upper belt pressing unit 4 and the lower belt pressing unit 5 on the front surfaces of the belt pressing surface 4*a* and the belt pressing surface 5*a* of which the friction plate 8 is installed. In this case, the upper and lower belt pressing units 4, 5 are constructed of steel from the viewpoints of the necessity of minimizing the deflection strength thereof and weldability of the closed box constructions for cooling water, and a JIS cold-rolled steel sheet or copper or copper alloy sheet or cold-rolled thin sheet such as an aluminum sheet can freely be selected as a material for the friction plate 8 from marketed inexpensive materials, and these proposed sheet materials have heat conductivity equal to or better than that of the material of the belt pressing units 4, 5.

Uneven lubrication or insufficient lubrication of the friction surface, which are considered as one of causes for a slipping phenomenon between the endless belts 1 and the slit band sheets a or a snaking phenomenon of the slit band sheets a, result from a problem fatal to the current disposition or method of disposing the lubricant 9*a* with respect to the internal belt surfaces 1*a*. Even though a lubricating component is successfully applied to the internal belt surfaces 1*a*, when the belt internal surfaces 1*a* come into rotational connection with the groove bottom portions of the pulleys or outer circumferences of oval drums, the lubricating component is discharged, and a sufficient lubricating effect is not obtained on the friction surface which really needs to be lubricated. Therefore, the friction plate 8 or only a front surface side 8*b* thereof is made of a material having a lubricating effect.

Namely, the friction plate 8 is made of a material having a self lubricating effect such as a thin metallic sheet on which a thin coating (for example, a thickness of the order of 0.5 mm) is formed which contains a self lubricating component such as molybdenum, graphite or fluorine plastic, for example, whereby the lubricating effect can be produced directly in the friction surface pressed without using the separate lubricant applying unit 9 for lubricating the internal belt surfaces 1*a*.

Figure 12:
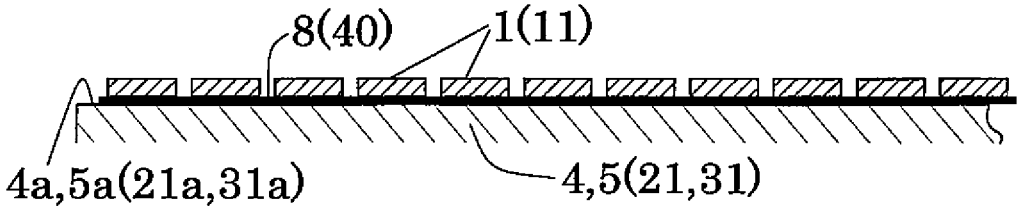
FIG. 12 shows Embodiments 1, 2 for carrying out the invention, in which FIGS. 12 (A) to 12(E) are partial sectional views showing friction plates and endless belts of various widths.
Figure 12:
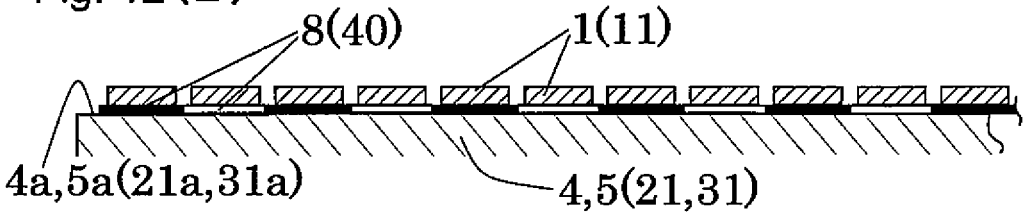
Figure 12:
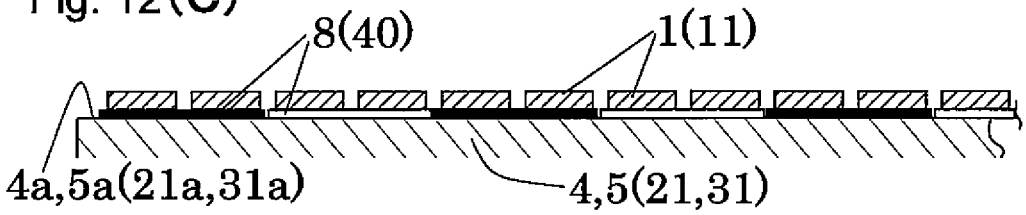
Figure 12:
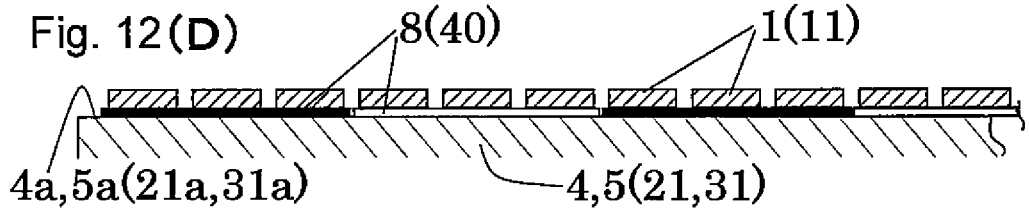
Figure 12:
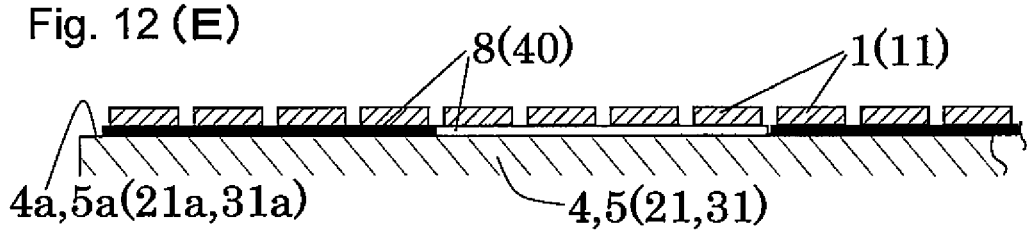
Figure 13:
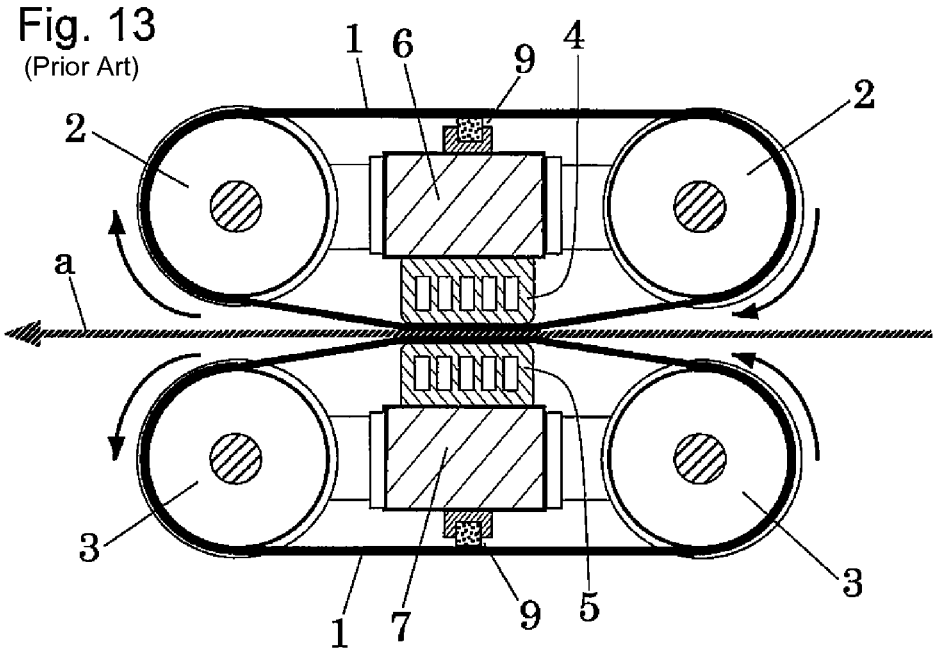
Fig. 13 (Prior Art)
FIG. 13 is a side sectional view of a conventional multiple endless belt type band sheet coiling tension applying apparatus employing pulleys.
Figure 14:
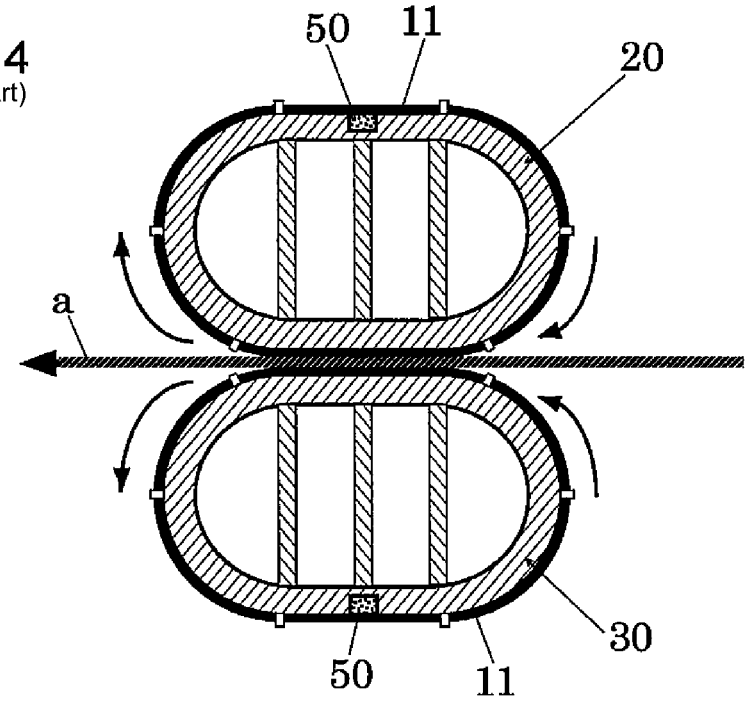
Fig. 14 (Prior Art)
FIG. 14 is a side sectional view of a conventional multiple endless belt type band sheet coiling tension applying apparatus employing oval drums.

The friction plate 8 may be made into a single wide plate which is superposed over the whole of each of the upper and lower belt pressing units 4, 5 in the longitudinal direction (refer to FIG. 12(A)). However, in the event that the friction plate 8 is divided into friction plates each having a width corresponding to the width of the single endless belt 1 (refer to FIG. 12(B)) or corresponding to widths resulting from adding up the widths of a plurality of endless belts 1 (refer to FIG. 12 (C) to (E)), when unbalanced wear occurs in a friction plate 8 or friction plates 8 which correspond to one or some of the endless belts 1 which are used frequently, only the friction plate 8 or friction plates 8 which correspond to the endless belt or endless belts which get so worn may be removed for replacement, whereby inexpensive and simple maintenance and control of the apparatus can be realized.

The lubricant applying unit 9 for lubricating the internal belt surfaces 1*a* of the endless belts 1 is provided at an upper central portion of the upper pressure applying member 6 as required. Similarly, the lubricant applying unit 9 for lubricating the internal belt surfaces 1*a* of the endless belts 1 is provided at a lower central portion of the lower pressure applying member 7 as required. The lubricant 9*a* which constitutes part of the lubricant applying unit 9 and which lubricates directly the internal belt surfaces 1*a* is accommodated within a recessed lubricant holder 9*b*. The lubricant 9*a* at the upper central portion of the upper pressure applying member 6 is accommodated so as to face upwards, while the lubricant 9*a* at the lower central portion of the lower pressure applying member 7 is accommodated so as to face downwards.

Namely, the lubricant 9*a*, in which paraffin which remains in a solid phase at normal temperatures while being transformed into a liquid phase when the temperature increases to surpass its fusion point is caused to soak into a non-woven fabric which is formed into a rod shape or a porous formed member, is disposed so as to be in contact with the internal belt surfaces 1*a* of the endless belts 1. Paraffin soaking into the interior of the lubricant 9*a* is eluted by friction heat generated by rotation of the endless belts 1 so as to lubricate the internal belt surfaces 1*a* of the endless belts 1 to thereby reduce the friction coefficient. Since the endless belts 1 are lubricated on the internal belt surfaces 1*a* thereof by the lubricant 9*a* while they are rotating, the slitting line does not have to be stopped frequently to lubricate the internal belt surfaces 1*a* of the endless belts 1, and therefore, the lubricant 9*a* contributes to an increase in productivity.

Next, the function of the embodiment for carrying out the invention based on the configuration described above will be described below.

The friction plate 8 is installed on the front surface of the belt pressing surface 4*a* which is situated on the lower surface of the upper belt pressing unit 4 provided below the upper pressure applying member 6 which constitutes the multiple endless belt type band sheet coiling tension applying apparatus employing pulleys. Similarly, the friction plate 8 is installed on the front surface of the belt pressing surface 5*a* which is situated on the upper surface of the lower belt pressing unit 5 provided above the lower pressure applying member 7.

The installation of the friction plate 8 is implemented by the fixing employing an adhesive, the fixing employing fitting grooves or fixing employing screws that have been described above, for example. In addition, depending upon the width of the slit band sheets a, the friction plate 8 so installed may take a form in which the friction plate 8 is made up of a single wide metallic sheet, a form in which the friction plate 8 is divided into friction plates each having a width corresponding to the width of the single endless belt 1 or a form in which the friction plate 8 is divided into friction plates each having a width corresponding to a width resulting from adding up the widths of a plurality of endless belts 1. When the friction plate 8 is the single wide metallic sheet, the installation work only has to be done once. When the friction plate 8 is divided into the plurality of friction plates, in replacing a worn friction plate or plates 8 with a replacement plate or plates, only the worn friction plate or plates 8 may have to be replaced, whereby the material costs can be reduced.

When the slit band sheets a are started to be wound, the front and back surfaces of the moving slit band sheets a are brought into frictional close contact with the external belt surfaces 1*b* of the upper and lower endless belts 1, whereby the upper and lower endless belts 1 are stretched into the substantially oval shape around the pairs of upper pulleys 2 and the pairs of lower pulleys 3, respectively, and circulate while being stretched into the substantially oval shape. As this occurs, the upper and lower endless belts 1 circulate independently of one another at the same speed together with the corresponding moving slit band sheets a without generating any slippage there-between.

On the other hand, the frictional force is generated by slippage occurring between the front surfaces of the friction plate 8 installed on the front surface of the belt pressing surface 4*a* of the upper belt pressing unit 4 which is pressed by the upper pressure applying member 6 and the friction plate 8 installed on the front surface of the belt pressing surface 5*a* of the lower belt pressing unit 5 which is pressed by the lower pressure applying member 7 and the internal belt surfaces 1*a* of the upper and lower endless belts 1. That is, the upper belt pressing unit 4 and the lower belt pressing unit 5, which press the internal belt surfaces 1*a* of the endless belts 1 which circulate while being stretched into the substantially oval shape by the frictional engagement with the moving slit band sheets a, perform a so-called braking function. By the frictional force so generated or the braking function, a required coiling tension is generated in the individual slit band sheets a which are situated between the slit band sheet coiling apparatus and the multiple endless belt type band sheet coiling tension applying apparatus employing pulleys.

In addition, friction heat generated by friction between the friction plate 8 installed on the belt pressing surface 4*a* of the upper belt pressing unit 4 and the internal belt surfaces 1*a* of the upper endless belts 1 is conducted from the belt pressing surface 4*a* of the upper belt pressing unit 4 to the back surface side 4*c* of the belt pressing surface through the friction plate 8, and part of the friction heat so conducted is further conducted to the reinforcement plates 4*d* of the cooling water chamber 4*b*. The back surface side 4*c* of the belt pressing surface constitutes the bottom surface side of the cooling water chamber 4*b* provided in the interior of the upper belt pressing unit 4, and the reinforcement plates 4*d* double as the heat dissipating plates. Thus, the friction heat is cooled down by cooling water which flows or circulates in the cooling water chamber 4*b*.

Similarly, friction heat generated by friction between the friction plate 8 installed on the belt pressing surface 5*a* of the lower belt pressing unit 5 and the internal belt surfaces 1*a* of the lower endless belts 1 is conducted from the belt pressing surface 5*a* of the lower belt pressing unit 5 to the back surface side 5*c* of the belt pressing surface through the friction plate 8, and part of the friction heat so conducted is further conducted to the reinforcement plates 5*d* of the cooling water chamber 4*b*. The back surface side 5*c* of the belt pressing surface constitutes the ceiling surface side of the cooling water chamber 5*b* provided in the interior of the lower belt pressing unit 5, and the reinforcement plates 5*d* double as the heat dissipating plates. Thus, the friction heat is cooled down by cooling water which flows or circulates in the cooling water chamber 5*b*.

In this way, the friction heat generated by the friction between the friction plates 8 installed on the belt pressing surfaces 4*a*, 5*a* of the upper and lower belt pressing units 4, 5 and the internal belt surfaces 1*a* of the upper and lower endless belts 1 is dissipated by the cooling water flowing or circulating in the cooling water chambers 4*b*, 5*b* which are provided in the interiors of the upper and lower belt pressing units 4, 5, respectively, whereby the occurrence of overheat damage trouble of the endless belts 1 is prevented.

In addition, when the friction plate 8 wears as a result of pressing directly the internal belt surfaces 1*a* of the endless belts 1, the friction plate 8 that gets so worn is removed from the belt pressing surface 4*a* of the upper belt pressing unit 4 or the belt pressing surface 5*a* of the lower belt pressing unit 5, and a new friction plate 8 is installed on the belt pressing surface 4*a* or the belt pressing surface 5*a*. This replacement work can be implemented without removing the upper belt pressing unit 4 or the lower belt pressing unit 5 from the main body structure, thereby making it possible to reduce largely the labors and time involved and the replacement costs incurred in the conventional replacement work.

The friction plate 8 which is made by bending the thin metallic sheet can be superposed on the belt pressing surfaces 4*a*, 5*a*, and further, in the event that the thin metallic sheet on which the sintered layer of the material having the self lubricating function is used on the front surface side 8*b* of the friction plate 8, the lubricating effect is imparted to the friction portion itself, and this obviates the necessity of the separate lubricant applying unit 9 for lubricating the internal belt surfaces 1*a* of the endless belts 1, whereby the maintenance work of the lubricant 9*a* is also made unnecessary which would otherwise be implemented by temporarily stopping the slitting line. In addition, since there is no liquefied lubricating oil and fat, the possibility of an operation disrupting accident of fouling the endless belts 1 and the slit band sheets a is also eliminated.

As is shown in FIG. 12, in the event that an approach is adopted in which friction plates 8 of the thin metallic sheet which are divided to match individual endless belts or a plurality of endless belts are installed to be superposed on the belt pressing surfaces 4*a*, 5*a*, friction plates 8 can be mass produced as small standard parts, whereby replacement part costs can be reduced largely. In addition, in general, since the central portion and portions therearound of the slit band sheet coiling apparatus are used more frequently, the central portion and portions therearound of the friction plate 8 wear intensely. However, only the friction plate or plates 8 at the arbitrary position where such wear occurs can be removed individually for replacement, whereby a large advantage can be provided in maintenance and control of the apparatus.

(Embodiment 2)

In FIGS. 1 to 4 to 12, a multiple endless belt type band sheet coiling tension applying apparatus employing oval drums is a apparatus for applying a predetermined coiling tension to slit band sheets a which are wound around a slit band sheet coiling apparatus, not shown, and is disposed in an intermediate position along the length of a moving passage for slit band sheets a which lies before the slit band sheet coiling apparatus, not shown.

The multiple endless belt type band sheet coiling tension applying apparatus employing oval drums includes mainly a plurality of endless belts 11 which are held so as to circulate continuously in such a state that they are each stretched into a substantially oval shape while being arranged to face each other vertically and which are arranged side by side in a widthwise direction and a pair of oval pressure applying members, that is, an upper oval pressure applying member 20 and a lower oval pressure applying member 30 around outer circumferences of which the upper and lower endless belts 11 move individually while being stretched into the substantially oval shape, respectively, and which press internal belt surfaces 11*a* of the upper and lower endless belts 11, respectively. The upper and lower oval pressure applying members 20, 30 are supported on stands, not shown, and the applying of pressure by each of the oval pressure applying members 20, 30 is implemented by a hydraulic cylinder, not shown as well.

The upper pressure applying member 20 presses downwards the endless belts 11 which are disposed on the upper side, while the lower pressure applying member 30 presses upwards the endless belts 11 which are disposed on the lower side. The upper pressure applying member 20 and the lower pressure applying member 30 cooperate with each other so as to hold indirectly slit band sheets a which pass between the upper and lower endless belts 11 which face each other vertically via the endless belts 11 from above and below the slit band sheets a under the same pressure to thereby apply a predetermined coiling tension to the slit band sheets a.

The endless belt 11 is disposed so as to circulate continuously in a traveling direction of the slit band sheets a, and the plurality of endless belts 1 are disposed side by side in the transverse direction, that is, the direction which intersects the traveling direction of the slit band sheets a. Further, the plurality of endless belts 1 which are so arranged are disposed so as to face vertically the plurality of endless belts 1 which are arranged in the same way.

The endless belts 1 which are disposed so as to face each other vertically while being arranged side by side in the transverse direction are each made up of an endless belt. The endless belts 11 are stretched into the substantially oval shape around the outer circumference of the upper oval pressure applying member 20 which is disposed on the upper side and the outer circumference of the lower oval pressure applying member 30 so as to move therearound independently. Each endless belt 11 is installed so as to circulate independently in the traveling direction of the corresponding slit band sheet a.

A drive source for causing the endless belts 11 to circulate is provided on neither the upper oval pressure applying member 20 nor the lower oval pressure applying member 30 around which the endless belts 11 are installed, and therefore, the endless belts 11 circulate only through a frictional engagement with the moving slit band sheets a and hence do not circulate by themselves. Namely, the endless belts 11 which are installed around the upper oval pressure applying member 20 and the lower oval pressure applying member 30 do not circulate unless the endless belts 11 are brought into contact with the slit band sheets a.

An external belt surface 11*b* of the endless belt 11 is joined to the corresponding slit band sheet a and functions to move the slit strap a. In contrast to this, an internal belt surface 11*a* of the endless belt 11 functions to generate a coiling tension in the slit band sheet a by a frictional force generated by slippage between itself and the upper oval pressure applying member 20 and the lower oval pressure applying member 30. Because of this, the internal belt surface 11*a* has a smaller friction coefficient than that of the external belt surface 11*b* of the endless belt 11 so that the internal belt surface 11*a* becomes easy to slip.

The internal belt surface 11*a* of the endless belt 11 is formed of a woven fabric of synthetic fibers so that a lubricant soaks between interwoven fibers and recessed interstices of the woven fabric, and a flexible material having a high friction coefficient is laminated on the external belt surface 11*b* of the endless belt 11.

By employing the woven fabric as the internal belt surface 11*a* of the endless belt 11, the lubricant is allowed to soak between the interwoven fibers and into the recessed interstices of the woven fabric in advance so as to reduce the friction coefficient of the internal belt surface 11*a* of the endless belt 11. In addition, since the woven fabric differs from a solid plate-like material and is characterized by large flexibility, the rotational resistance of the endless belt 11 which is installed around each of the upper and lower oval pressure applying members 20, 30 is small. Synthetic fiber materials such as polyester, Vinylon and nylon can be used for the woven fabric.

The external belt surface 11*b* of the endless belt 11 is formed of a material having a larger friction coefficient than that of the internal belt surface 11*a* of the endless belt 1. Namely, a wear-resistant material, for example, a soft synthetic resin fibrous material having a low friction coefficient is used as an internal belt surface material of the endless belt 11, and an elastic element having a high friction coefficient, for example, a rubber or synthetic resin sheet material is laminated as an external surface material. Further, a configuration may be adopted in which the friction coefficient of the internal belt surface 11*a* is made smaller than the friction coefficient of the external belt surface 11*b* of the endless belt 11 by using a method of applying a lubricant on the internal belt surface 11*a* of the endless belt 11 and sliding surfaces of the upper oval pressure applying member 20 and the lower oval pressure applying member 30.

The upper oval pressure applying member 20 is placed so as to extend through the insides of the multiplicity of endless belts 11 which are disposed on the upper side. The upper oval pressure applying member 20 which is placed in such a state includes integrally a belt pressing portion 21 which has a straight-line side section and which is adapted to press downwards the internal belt surfaces 11*a* of the endless belts 11, a belt guide portion 22 which is provided above the belt pressing portion 21 and parallel thereto and which has a straight-line side section, and belt reversing portions 23 which are formed at side edges of the upper belt guide portion 22 and the lower belt pressing portion 21 and which each have an arcuate or semi-arcuate side section.

The upper oval pressure applying member 20 is formed into an oval shape in section, for example, by the upper belt guide portion 22, the lower belt pressing portion 21 and the belt reversing portions 23 having the semi-arcuate side section, for example, which are formed at the side edges of the belt guide portion 22 and the belt pressing portion 21. Other shapes than the semi-arcuate shape can be considered as the shape of the belt reversing portion 23, which include a partially oval arcuate shape or a partially parabolic shape. As this occurs, the upper oval pressure applying member 20 has a substantially oval section. The upper oval pressure applying member 20 is placed so that its longitudinal direction intersects the traveling direction of the slit band sheets a at right angles and the upper oval pressure applying member 20 extends through the insides of the endless belts 11.

The plurality of endless belts 11, which are disposed side by side in the transverse direction, move independently around the outer circumference of the upper oval pressure applying member 20 which has the substantially oval section. A surface of the outer circumference of the upper oval pressure applying member 20 is finished to have an oval shape, so that the endless belts 11 can circulate the upper oval pressure unit 20 smoothly while being stretched into the oval shape.

A belt pressing surface 21*a* on a lower surface of the belt pressing portion 21 is a portion which presses the slit band sheets a via the endless belts 11 under a surface contact pressure which has a predetermined length with respect to the traveling direction of the slit band sheets a to thereby apply a coiling tension to the slit band sheets a. Because of this, the belt pressing portion 21 and the belt pressing surface 21*a* on the lower surface of the belt pressing portion 21 are each formed into a straight line which has a predetermined length with respect to the traveling direction of the slit band sheets a so as to become parallel to the slit band sheets a which pass thereunder. In addition, the belt pressing portion 21 and the belt pressing surface 21*a* are formed so as to press uniformly the internal belt surfaces 11*a* of the endless belts 11 which are disposed side by side in the transverse direction.

The endless belts 11, which are pressed at the internal belt surfaces 11*a* by the belt pressing portion 21 so that the external belt surfaces 11*b* are brought into direct contact with the slit band sheets a, circulate together with the slit band sheets a at the same speed without slipping on the slit band sheets a by the close attachment thereto. A front surface of the belt pressing portion 21 which is brought into contact with the endless belts 11 is formed into a flat plane and is finished so that friction with the internal belt surfaces 11*a* of the endless belts 11 becomes small.

A plurality of belt guide protrusions 24 for guiding separately the endless belts 11 which are disposed side by side in the transverse direction are provided circumferentially at predetermined intervals on the outer circumference of the upper oval pressure applying member 20 so as to project there-from. The belt guide protrusions 24 prevent the endless belts 11 from snaking or changing their courses in the widthwise direction. Although a plurality of belt guide protrusions 24 are provided at appropriate intervals on both the belt reversing portions 23, belt guide protrusions 24 are also provided on the belt guide portion 22 as required. Although normal pins are used for the belt guiding projections 24, plate-like belt guide protrusions, for example, may be used from time to time in addition to the pins.

A cooling water chamber 25 is provided in an interior of the upper oval pressure applying member 20 having the belt pressing surface 21*a* on the lower surface of the belt pressing portion 21 in a direction in which it traverses the endless belts arranged side by side in the transverse direction. The cooling water chamber 25 prevents the overheating of the endless belts 11 which circulate continuously the outer circumference of the upper oval pressure applying member 20 by friction heat. Namely, the endless belts 11 are prevented from being overheated by allowing friction heat generated to escape to the cooling water chamber 25 through the belt pressing surface 21*a*.

As has been described before, a thickness defined between the belt pressing surface 21*a* and a back surface side 21*b* of the belt pressing surface which constitutes a bottom surface side of the cooling water chamber 25 which contacts cooling water is made as thin as possible while bearing the pressing force in order to conduct the friction heat to the cooling water in the cooling water chamber 25 as efficiently as possible.

The interior of the cooling water chamber 25 is reinforced and partitioned by reinforcement plates 25*a*. The reinforcement plates 25*a* also function as heat dissipating plates which dissipate heat conducted thereto from a friction plate 40 via the belt pressing surface 21*a* to the interior of the cooling water chamber 25. The reinforcement plates 25*a* which reinforce the cooling water chamber 25 defined in the interior of the upper oval pressure applying member 20 function to retain the shape of the upper oval pressure applying member 20 whose interior becomes hollow due to the formation of the cooling water chamber 25. Namely, although compression forces act on the upper oval pressure applying member 20 which presses the endless belts 11 downwards from above and below, the reinforcement plates 25*a* function to resist the compression forces to thereby prevent the upper oval pressure applying member 20 from being deflected or curved in the longitudinal direction.

As has been described above, the belt pressing surface 21*a* on the lower surface of the upper oval pressure applying member 20 wears gradually, and irregularities produced thereon grow intensely, whereby the multiplicity of slit band sheets a snake or the coiling tension applied thereto becomes uneven, leading to a failure of coiling the split band sheets a into a coil as a product. Then, the friction plate 40, which will be described later, is detachably installed on a front surface of the belt pressing surface 21*a*.

The lower oval pressure applying member 30 is placed so as to extend through the insides of the multiplicity of endless belts 11 which are disposed on the lower side. The lower oval pressure applying member 30 which is placed in such a state includes integrally a belt pressing portion 31 which has a straight-line side section and which is adapted to press upwards the internal belt surfaces 11*a* of the endless belts 11, a belt guide portion 32 which is provided below the belt pressing portion 31 and parallel thereto and which has a straight-line side section, and belt reversing portions 33 which are formed at side edges of the lower belt guide portion 32 and the upper belt pressing portion 31 and which each have an arcuate or semi-arcuate side section.

The lower oval pressure applying member 30 is formed into an oval shape in section, for example, by the upper belt pressing portion 31, the lower belt guide portion 32 and the belt reversing portions 33 having the semi-arcuate side section, for example, which are formed at the side edges of the belt pressing portion 31 and the belt guide portion 32. Other shapes than the semi-arcuate shape can be considered as the shape of the belt reversing portion 33, which include a partially oval arcuate shape or a partially parabolic shape. As this occurs, the lower oval pressure applying member 30 has a substantially oval section. The lower oval pressure applying member 30 is placed so that its longitudinal direction intersects the traveling direction of the slit band sheets a at right angles and the lower oval pressure applying member 30 extends through the insides of the endless belts 11.

The plurality of endless belts 11, which are disposed side by side in the transverse direction, move independently around the outer circumference of the lower oval pressure applying member 30 which has the substantially oval section. A surface of the outer circumference of the lower oval pressure applying member 30 is finished to have an oval shape, so that the endless belts 11 can circulate the lower oval pressure unit 30 smoothly while being stretched into the oval shape.

A belt pressing surface 31*a* on an upper surface of the belt pressing portion 31 is a portion which presses the slit band sheets a via the endless belts 11 under a surface contact pressure which has a predetermined length with respect to the traveling direction of the slit band sheets a to thereby apply a coiling tension to the slit band sheets a. Because of this, the belt pressing portion 31 and the belt pressing surface 31*a* on the upper surface of the belt pressing portion 31 are each formed into a straight line which has a predetermined length with respect to the traveling direction of the slit band sheets a so as to become parallel to the slit band sheets a which pass thereabove. In addition, the belt pressing portion 31 and the belt pressing surface 31*a* are formed so as to press uniformly the internal belt surfaces 11*a* of the endless belts 11 which are disposed side by side in the transverse direction.

The endless belts 11, which are pressed at the internal belt surfaces 11*a* by the belt pressing portion 31 so that the external belt surfaces 11*b* are brought into direct contact with the slit band sheets a, circulate together with the slit band sheets a at the same speed without slipping on the slit band sheets a by the close attachment thereto. A front surface of the belt pressing portion 31 which is brought into contact with the endless belts 11 is formed into a flat plane and is finished so that friction with the internal belt surfaces 11*a* of the endless belts 11 becomes small.

A plurality of belt guide protrusions 34 for guiding separately the endless belts 11 which are disposed side by side in the transverse direction are provided circumferentially at predetermined intervals on the outer circumference of the lower oval pressure applying member 30 so as to project therefrom. The belt guide protrusions 34 prevent the endless belts 11 from snaking or changing their courses in the widthwise direction. Although a plurality of belt guide protrusions 34 are provided at appropriate intervals on both the belt reversing portions 33, belt guide protrusions 34 are also provided on the belt guide portion 32 as required. Although normal pins are used for the belt guiding projections 34, plate-like belt guide protrusions, for example, may be used from time to time in addition to the pins.

A cooling water chamber 35 is provided in an interior of the lower oval pressure applying member 30 having the belt pressing surface 31*a* on the upper surface of the belt pressing portion 31 in a direction in which it traverses the endless belts arranged side by side in the transverse direction. The cooling water chamber 35 prevents the overheating of the endless belts 11 which circulate continuously the outer circumference of the lower oval pressure applying member 30 by friction heat. Namely, the endless belts 11 are prevented from being overheated by allowing friction heat generated to escape to the cooling water chamber 35 through the belt pressing surface 31*a*.

As has been described before, a thickness defined between the belt pressing surface 31*a* and a back surface side 31*b* of the belt pressing surface which constitutes a ceiling surface side of the cooling water chamber 25 which contacts cooling water is made as thin as possible while bearing the pressing force in order to conduct the friction heat to the cooling water in the cooling water chamber 35 as efficiently as possible.

The interior of the cooling water chamber 35 is reinforced and partitioned by reinforcement plates 35*a*. The reinforcement plates 35*a* also function as heat dissipating plates which dissipate heat conducted thereto from a friction plate 40 via the belt pressing surface 31*a* to the interior of the cooling water chamber 35. The reinforcement plates 35*a* which reinforce the cooling water chamber 35 defined in the interior of the lower oval pressure applying member 30 function to retain the shape of the lower oval pressure applying member 30 whose interior becomes hollow due to the formation of the cooling water chamber 35. Namely, although compression forces act on the lower oval pressure applying member 30 which presses the endless belts 11 upwards from above and below, the reinforcement plates 35*a* function to resist the compression forces to thereby prevent the lower oval pressure applying member 30 from being deflected or curved in the longitudinal direction.

As has been described above, the belt pressing surface 31*a* on the upper surface of the lower oval pressure applying member 30 wears gradually, and irregularities produced thereon grow intensely, whereby the multiplicity of slit band sheets a snake or the coiling tension applied thereto becomes uneven, leading to a failure of coiling the split band sheets a into a coil as a product. Then, the following friction plate 40 is detachably installed on a front surface of the belt pressing surface 31*a*.

The friction plates 40 are formed of a thin metallic sheet having heat conductivity equal to or better than those of the belt pressing portion 21 of the upper oval pressure applying member 20 and the belt pressing portion 31 of the lower oval pressure applying member 30 and are detachably installed on front surfaces of the belt pressing surfaces 21*a*, 31*a* of the belt pressing units 21, 31. The friction plates 40 contact directly the internal belt surfaces 11*a* of the endless belts 11 in place of the upper and lower belt pressing surfaces 21*a*, 31*a* to function to prevent the direct wear of the respective belt pressing surfaces 21*a*, 31*a* which are configured as integral parts of the lower surface side of the upper belt pressing unit 21 and the upper surface side of the lower belt pressing unit 31.

Figure 8:
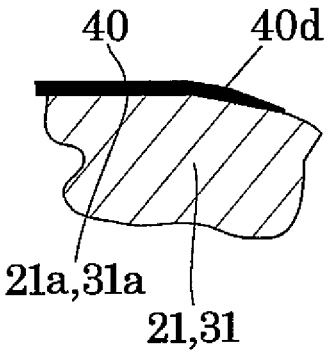
Figure 8:
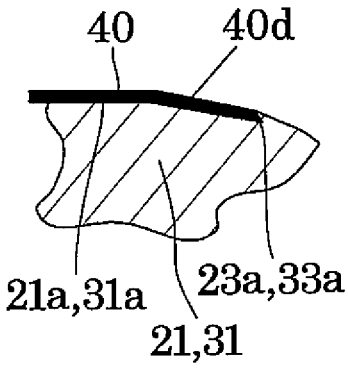
Figure 8:
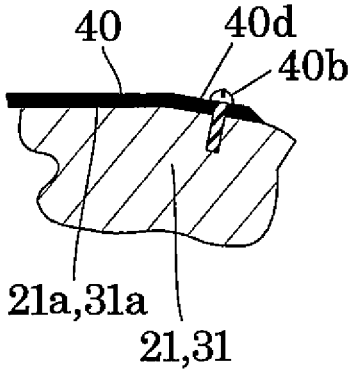

The friction plates 40 are installed so as to be closely attached to the front surfaces of the belt pressing surfaces 21*a*, 31*a*. Further, when pressed against the slit band sheets a, since the friction plates 40, formed of the thin metallic sheet, are strongly closely attached to the front surfaces of the belt pressing surfaces 21*a*, 31*a* by the pressing force, friction heat generated between the internal belt surfaces 11*a* of the endless belts 11 and the friction plates 40 is conducted smoothly from the friction plates 40 to the belt pressing surfaces 21*a*, 31*a* by the close attachment. In addition, as is shown in FIG. 8, the installation of the friction plates 40 on the front surfaces of the belt pressing surfaces 21*a*, 31*a* is implemented through, for example, fixing employing an adhesive (refer to FIG. 8(A)), fixing employing groove fitting (refer to FIG. 8(B)), or fixing employing screws (refer to FIG. 8(C)).

In the case of the fixing employing an adhesive (refer to FIG. 8(A)), although an adhesive is applied to either or both of the front surfaces of the belt pressing surfaces 21*a*, 31*a* and back surface sides which constitute adhesion sides of the friction plates 40, an adhesive which does not disturb the heat conduction is used as the adhesive so applied. Both side edge portions of the friction plate 40 are made thinner towards their distal edges so as not to damage the internal belt surfaces 11*a* of the endless belts 11.

In addition, in the case of the fixing employing groove fitting (refer to FIG. 8(B)), engagement grooves 23*a*, 33*a* into which the side edge portions of the friction plates 40 are fitted are formed in lower portion sides of the belt reversing portions 23 which contact front and rear edge sides of the belt pressing portion 21 and upper portion sides of the belt reversing portions 33 which contact front and rear edge sides of the belt pressing portion 31, respectively. Then, when the friction plate 40 is installed on the upper belt pressing surface 21*a*, horizontal edge portions of the friction plate 40 are bent slightly in an upwardly inclined direction, and side distal edges thereof are fitted in the engagement grooves 23*a*, whereby the friction plate 40 is attached to the upper belt pressing surface 21*a*. Similarly, when the friction plate 40 is installed on the lower belt pressing surface 31*a*, horizontal edge portions of the friction plate 40 are bent slightly in a downwardly inclined direction, and side distal edges thereof are fitted in the engagement grooves 33*a*, whereby the friction plate 40 is attached to the lower belt pressing surface 31*a*. Even though the friction plate 40 is bent slightly, the bending is implemented within an elastic range of the thin metallic sheet, and therefore, the friction plates 40 are closely attached to the upper and lower pressing surfaces 21*a*, 31*a* after having been installed thereon.

Figure 9:
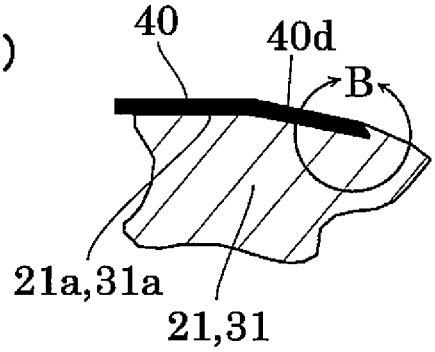
Figure 9:
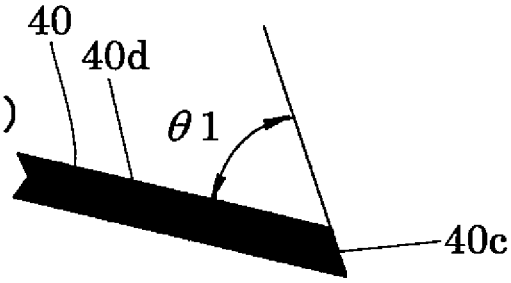
Figure 9:
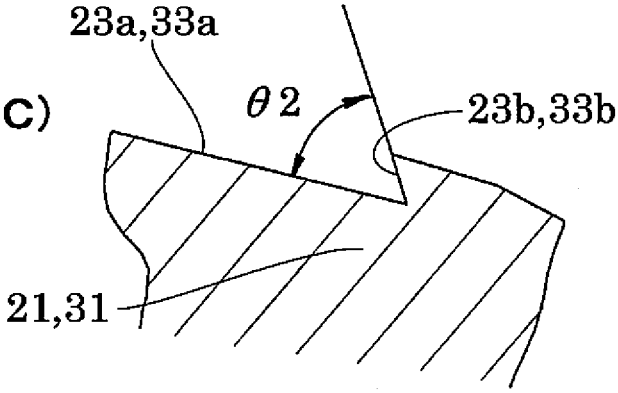
Figure 9:
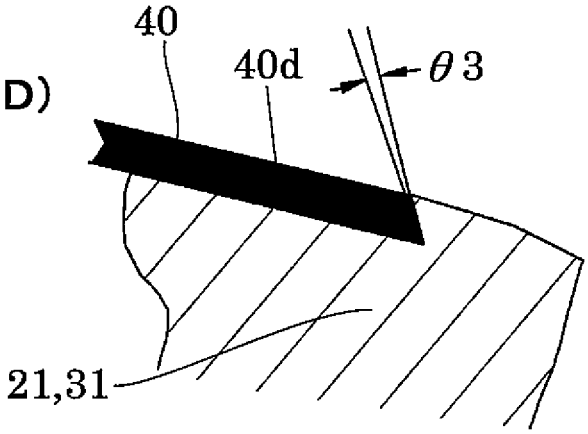
Figure 10:
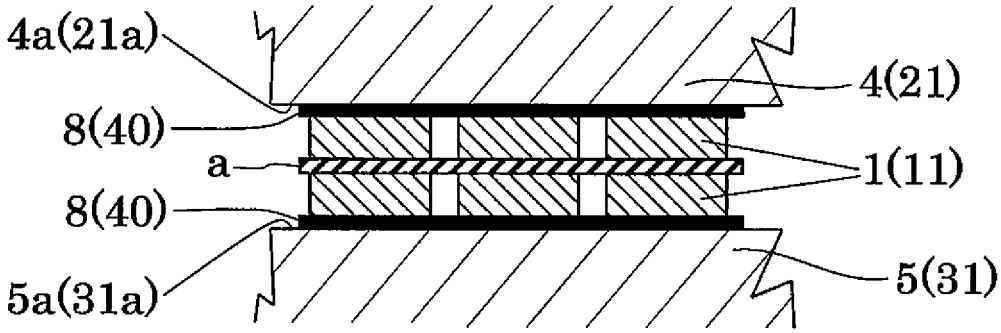
FIG. 10 is a partial sectional view of Embodiment 2 for carrying out the invention, which shows a state in which friction plates are installed on belt pressing surfaces of the belt pressing units or the oval pressure applying members.
Figure 11:
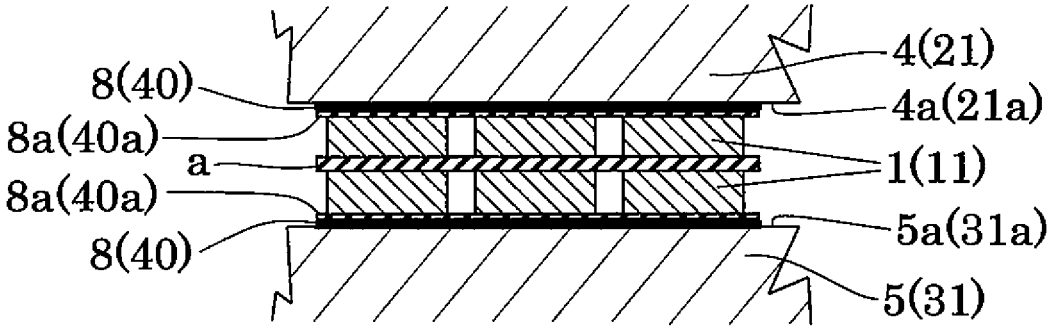
FIG. 11 is a partial sectional view of Embodiment 2 for carrying out the invention, which shows a state in which friction plates on front surface sides of which self lubricating coatings are formed are installed on the belt pressing surfaces of the belt pressing units or the oval pressure applying members.

As is shown in FIG. 9, both the side edge portions of the friction plates 40 are worked to be finished at a predetermined inclination angle θ1 (for example, at 45 degrees) at side distal edge portions 40*d* (refer to FIG. 9(B)) so as to be easily fitted in the engagement grooves 23*a*, 33*a*. The inclination angle θ1 is preferably in the range from 30 degrees to 60 degrees. In addition, in order to match the side distal edge portions 40*d* so worked, respective groove end portions 23*b*, 33*b* of the upper and lower engagement grooves 23*a*, 33*a* which correspond to the side distal edge portions 40*d* where both the side edge portions of the friction plates 40 are fitted therein are also similarly finished with a predetermined inclination angle θ2 (for example, an angle slightly larger than 45 degrees) to complete fitting grooves (refer to FIG. 9(C)). The inclination angle θ2 of the groove end portions 23*b*, 33*b* is made larger than the inclination angle θ1 of the side distal edge portions 40*d* to thereby produce an angular difference θ3 which ranges from 0.5 degree to approximately 2 degrees (refer to FIG. 9(D)).

Namely, inclination angle θ2>inclination angle θ1, and the angular difference θ3=θ2−θ1=0.5 degree to approximately 2 degrees. The angular difference θ3 is necessary for the friction plates 40 to be installed in the engagement grooves 23*a*, 33*a* in an engaged fashion so as to be securely fixed therein.

Further, in the case of the fixing employing screws (refer to FIG. 8(C)), the side edge portions of the friction plates 40 are bent along their inclined directions towards the lower portion sides of the belt reversing portions 23 which connect to the front and rear side edge portions of the belt pressing portion 21 and the upper portion sides of the belt reversing portions 33 which connect to the front and rear side edge portions of the belt pressing portion 31, and the side edge portions of the friction plates 40 are fixed thereto with fixing screws 40*b*. The side edge portions of the friction plates 40 are made thinner towards the side distal edges thereof. The fixing screws 40*b* are disposed in intermediate gaps between the endless belt 11, whereby there is caused no such situation that the fixing screws 40*b* disturb the rotation of the endless belts 11.

As a means for facilitating the maintenance and control of the belt pressing surfaces 21*a*, 31*a* of the belt pressing units 21, 31 with respect to unbalanced wear thereon without reducing the deflection strength of the upper and lower belt pressing units 21, 31 and reducing the heat conductivity which enables the conduction of friction heat to the cooling water chambers 25, 35, the friction plates 40 which are each formed of the thin metallic sheet which is several millimeters thick (for example, from 0.5 mm to approximately 2.5 mm) are disposed to be superposed on friction surfaces on the front surfaces of the belt pressing surfaces 21*a*, 31*a*.

As was described in the previous paragraph of "Related Art," although the thickness defined between the belt pressing surface 21*a*, 31*a* and the back surface side 21*b*, 31*b* of the belt pressing surface which contacts the cooling water chamber 25, 35 which contacts in turn cooling water in the cooling water chamber 25, 35 is designed in consideration of heat conduction, deflection strength and abrasion margin (normally, up to approximately 3 mm) for wear, in order to enable a continuous operation of the apparatus without trouble resulting from the overheat of the endless belts 11, the thickness should be not more than the conventional thickness. Then, by paying attention to this abrasion margin, the idea has been reached that the abrasion margin is designed thinner than that of the conventional upper and lower belt pressure applying members 20, 30 and the friction plate 40 formed of the thin metallic sheet whose thickness corresponds to the reduced amount of abrasion margin is disposed to be superposed on each of the belt pressing surfaces 21*a*, 31*a*. In addition, the thickness of the friction plate 40 formed of the thin metallic sheet which is disposed to be so superposed should be limited to a range of 0.5 mm to approximately 2.5 mm in consideration of workability such as press bending and heat conduction loss of friction heat by the disposition of the friction plates 40 on the upper and lower belt pressing units 21, 31.

As a thin metallic sheet material used as the friction plate 40, it is possible to use, for example, JIS (JIS G 3141) cold-rolled steel sheet and steel band sheet, JIS (JIS H 3100) copper and copper alloy sheet or JIS (JIS H 4000) cold-rolled aluminum or aluminum alloy sheet, these metallic sheets having a good heat conductivity. However, in any case, a bright finished sheet material which is smooth finished by a rolling role which is finished smoothly is preferred, and a hard-finished quenched and tempered sheet material is preferred from the viewpoint of wear prevention. Of course, in this case, too, a lubricant 50, which will be described later, is provided as required, and the lubricant 50 adhering to the internal belt surface 11*a* of the endless belt 11 lubricates the surface of the friction plate 40. However, when an uneven applying of coiling tension is caused due to gradual wear of the friction plate 40 resulting from the long use thereof, only the friction plate 40 formed of the thin metallic sheet which gets so worn can be removed for replacement.

The friction plate 40 is formed of the thin metallic sheet whose thickness is in the range of, for example, 0.5 mm to approximately 2.5 mm as has been described above, and a total thickness of the thickness defined between the lower surface side or the belt pressing surface 21*a* of the upper oval pressure applying member 20 where friction heat is generated and the back surface side 21*b* of the belt pressing surface and the thickness of the friction plate 40 which is superposed on the belt pressing surface 21*a* is equal to or thinner than the thickness defined between the belt pressing surface 21*a* and the back surface side 21*b* of the conventional belt pressing unit 21. Similarly, a total thickness of the thickness defined between the upper surface side or the belt pressing surface 31*a* of the lower oval pressure applying member 30 where friction heat is generated and the back surface side 31*b* of the belt pressing surface and the thickness of the friction plate 40 which is superposed on the belt pressing surface 31*a* is equal to or thinner than the thickness defined between the belt pressing surface 31*a* and the back surface side 31*b* of the conventional lower oval pressure applying member 30.

The friction plates 40 of the thin metallic sheet, which are held and pressed by the upper and lower oval pressure applying members 20, 30 so as to generate a coiling tension by a friction force on the internal belt surfaces 1*a* of the endless belts 11, are easily closely attached to the front surfaces of the belt pressing surfaces 21*a*, 31*a*. Therefore, as with the conventional integrated construction, friction heat generated by the coiling operation of the slit band sheets a is conducted to the cooling water chambers 25, 35 in the interiors of the oval pressure applying members 20, 30, and hence, there is caused no such situation that the cooling effect is reduced.

The design of this embodiment ensures a sufficient strength required to compensate for the reduction in thickness of the abrasion margins of the conventional oval pressure applying members 20, 30. In addition, the friction plates 40 formed of the thin metallic sheet are superposed on the front surfaces of the similar pressing unit box-shaped constructions to those of the conventional oval pressure applying members 20, 30, and hence, there is also caused no such situation that the rigidity and strength of the oval pressure applying members 20, 30 are insufficient.

Then, when the front surfaces of the friction plates 40 which contact directly the internal belt surfaces 11*a* of the endless belts 11 wear, the overall structures of the complex and expensive oval pressure applying members 20, 30 which are integrated with the cooling water chambers 25, 35, respectively, do not have to be replaced but only the friction plates 40 of the thin metallic sheet have to be removed for replacement. Moreover, the maintenance and control of this apparatus can be implemented by a quick and simple operation.

Incidentally, although the upper and lower endless belts 11 rotate continuously by being pressed and held by being pulled by the slit band sheets a while being pressed and held by the upper and lower oval pressure applying members 20, 30, corners of the oval pressure applying members 20, 30 on ingress and egress sides need to be rounded for fear that the internal belt surfaces 11*a* are damaged by the corner portions of the oval pressure applying members 20, 30. As this occurs, since the friction plate 40 formed of the thin metallic sheet which is only several millimeter thick can be press bent easily, rounded corner portions 40*d* can be provided on both sides of the friction plate 40 so as to prevent the damage of the internal belt surfaces 11*a*.

In addition, the friction plate 40 is made of the material which has heat conductivity equal to or better than those of the upper belt pressing unit 21 and the lower belt pressing unit 31 on the front surfaces of the belt pressing surface 21*a* and the belt pressing surface 31*a* of which the friction plate 40 is installed. In this case, the upper and lower belt pressing units 21, 31 are constructed of steel from the viewpoints of the necessity of minimizing the deflection strength thereof and weldability of the closed box constructions for cooling water, and a JIS cold-rolled steel sheet or copper or copper alloy sheet or cold-rolled thin sheet such as an aluminum sheet can freely be selected as a material for the friction plate 40 from marketed inexpensive materials, and these proposed sheet materials have heat conductivity equal to or better than that of the material of the belt pressing units 21, 31.

Uneven lubrication or insufficient lubrication of the friction surface, which are considered as one of causes for a slipping phenomenon between the endless belts 11 and the slit band sheets a or a snaking phenomenon of the slit band sheets a, result from a problem fatal to the current disposition or method of disposing the lubricant 50 with respect to the internal belt surfaces 11*a*. Even though a lubricating component is successfully applied to the internal belt surfaces 11*a*, when the belt internal surfaces 11*a* come into rotational connection with the outer circumferences of the oval drums, the lubricating component is discharged, and a sufficient lubricating effect is not obtained on the friction surface which really needs to be lubricated. Therefore, the friction plate 40 itself or only a front surface side 40*a* thereof is made of a material having a lubricating effect.

Namely, the friction plate 40 is made of a material having a self lubricating effect such as a thin metallic sheet on which a thin coating (for example, a thickness of the order of 0.5 mm) is formed which contains a self lubricating component such as molybdenum, graphite or fluorine plastic, for example, whereby the lubricating effect can be produced directly in the friction surface pressed without using the separate lubricant applying 50 for lubricating the internal belt surfaces 11*a*.

The friction plate 40 may be made into a single wide plate which is superposed over the whole of each of the upper and lower belt pressing units 21, 31 in the longitudinal direction (refer to FIG. 12(A)). However, in the event that the friction plate 40 is divided into friction plates each having a width corresponding to the width of the single endless belt 1 (refer to FIG. 12(B)) or corresponding to widths resulting from adding up the widths of a plurality of endless belts 11 (refer to FIG. 12 (C) to (E)), when unbalanced wear occurs in a friction plate 40 or friction plates 40 which correspond to one or some of the endless belts 11 which are used frequently, only the friction plate 40 or friction plates 40 which correspond to the endless belt or endless belts which get so worn may be removed for replacement, whereby inexpensive and simple maintenance and control of the apparatus can be realized.

The lubricant applying 50 for lubricating the internal belt surfaces 11*a* of the endless belts 11 is provided at a central portion of the upper oval pressure applying member 20 as required. Similarly, the lubricant applying 50 for lubricating the internal belt surfaces 11*a* of the endless belts 11 is provided at a central portion of the lower oval pressure applying member 30 as required.

The lubricant 50 which lubricates directly the internal belt surfaces 11*a* of the upper endless belts 11 is accommodated within a recessed lubricant holder 22*a* which is formed at a central portion of the belt guide portion 22 so as to face upwards. The lubricant 50 is accommodated so that an upper portion thereof which project upwards from the lubricant holder 22*a* is brought into contact with the internal belt sides 11*a* of the endless belts 11 which circulate above the upper belt guide portion 22.

In addition, the lubricant 50 which lubricates directly the internal belt surfaces 11*a* of the lower endless belts 11 is accommodated within a recessed lubricant holder 32*a* which is formed at a central portion of the belt guide portion 32 so as to face downwards. The lubricant 50 is accommodated so that a lower portion thereof which project downwards from the lubricant holder 32*a* is brought into contact with the internal belt sides 11*a* of the endless belts 11 which circulate below the lower belt guide portion 32.

Namely, the lubricant 50, in which paraffin which remains in a solid phase at normal temperatures while being transformed into a liquid phase when the temperature increases to surpass its fusion point is caused to soak into a non-woven fabric which is formed into a rod shape or a porous formed member, is disposed so as to be in contact with the internal belt surfaces 11*a* of the endless belts 11. Paraffin soaking into the interior of the lubricant 50 is eluted by friction heat generated by rotation of the endless belts 11 so as to lubricate the internal belt surfaces 11*a* of the endless belts 11 to thereby reduce the friction coefficient. Since the endless belts 11 are lubricated on the internal belt surfaces 11*a* thereof by the lubricant 50 while they are rotating, the slitting line does not have to be stopped frequently to lubricate the internal belt surfaces 11*a* of the endless belts 11, and therefore, the lubricant 50 contributes to an increase in productivity.

Next, the function of the embodiment for carrying out the invention based on the configuration described above will be described below.

The friction plate 40 is installed on the front surface of the belt pressing surface 21*a* which is situated on the lower surface of the upper belt pressing unit 21 provided below the upper oval pressure applying member 20 which constitutes the multiple endless belt type band sheet coiling tension applying apparatus employing oval drums. Similarly, the friction plate 40 is installed on the front surface of the belt pressing surface 31*a* which is situated on the upper surface of the lower belt pressing unit 31 provided above the lower oval pressure applying member 30.

The installation of the friction plate 40 is implemented by the fixing employing an adhesive, the fixing employing fitting grooves or fixing employing screws that have been described above, for example. In addition, depending upon the width of the slit band sheets a, the friction plate 40 so installed may take a form in which the friction plate 40 is made up of a single wide metallic sheet, a form in which the friction plate 40 is divided into friction plates each having a width corresponding to the width of the single endless belt 11 or a form in which the friction plate 40 is divided into friction plates each having a width corresponding to a width resulting from adding up the widths of a plurality of endless belts 11. When the friction plate 8 is the single wide metallic sheet, the installation work only has to be done once. When the friction plate 40 is divided into the plurality of friction plates, in replacing a worn friction plate or plates 40 with a replacement plate or plates, only the worn friction plate or plates 40 may have to be replaced, whereby the material costs can be reduced.

When the slit band sheets a are started to be wound, the front and back surfaces of the moving slit band sheets a are brought into frictional close contact with the external belt surfaces 11*b* of the upper and lower endless belts 11, whereby the upper and lower endless belts 11 circulate the outer circumferences of the upper oval pressure applying member 20 and the lower oval pressure applying member 30, respectively, while being stretched into the substantially oval shape. As this occurs, the upper and lower endless belts 11 circulate independently of one another at the same speed together with the corresponding moving slit band sheets a without generating any slippage there-between.

On the other hand, the frictional force is generated by slippage occurring between the front surfaces of the friction plate 40 installed on the front surface of the belt pressing surface 21*a* of the upper belt pressing unit 21 which is pressed by the upper oval pressure applying member 20 and the friction plate 40 installed on the front surface of the belt pressing surface 31*a* of the lower belt pressing unit 31 which is pressed by the lower oval pressure applying member 30 and the internal belt surfaces 11*a* of the upper and lower endless belts 11. That is, the upper belt pressing unit 21 and the lower belt pressing unit 31, which press the internal belt surfaces 11*a* of the endless belts 11 which circulate while being stretched into the substantially oval shape by the frictional engagement with the moving slit band sheets a, perform a so-called braking function. By the frictional force so generated or the braking function, a required coiling tension is generated in the individual slit band sheets a which are situated between the slit band sheet coiling apparatus and the multiple endless belt type band sheet coiling tension applying apparatus employing oval drums.

In addition, friction heat generated by friction between the friction plate 40 installed on the belt pressing surface 21*a* of the upper belt pressing unit 21 and the internal belt surfaces 11*a* of the upper endless belts 11 is conducted from the belt pressing surface 21*a* of the upper belt pressing unit 21 to the back surface side 21*b* of the belt pressing surface through the friction plate 40, and part of the friction heat so conducted is further conducted to the reinforcement plates 25*a* of the cooling water chamber 25. The back surface side 21*b* of the belt pressing surface constitutes the bottom surface side of the cooling water chamber 25 provided in the interior of the upper belt pressing unit 21, and the reinforcement plates 25*a* double as the heat dissipating plates. Thus, the friction heat is cooled down by cooling water which flows or circulates in the cooling water chamber 25.

Similarly, friction heat generated by friction between the friction plate 40 installed on the belt pressing surface 31*a* of the lower belt pressing unit 31 and the internal belt surfaces 11*a* of the lower endless belts 11 is conducted from the belt pressing surface 31*a* of the lower belt pressing unit 31 to the back surface side 31*b* of the belt pressing surface through the friction plate 40, and part of the friction heat so conducted is further conducted to the reinforcement plates 35*a* of the cooling water chamber 35. The back surface side 31*b* of the belt pressing surface constitutes the ceiling surface side of the cooling water chamber 35 provided in the interior of the lower belt pressing unit 31, and the reinforcement plates 35*a* double as the heat dissipating plates. Thus, the friction heat is cooled down by cooling water which flows or circulates in the cooling water chamber 35.

In this way, the friction heat generated by the friction between the friction plates 40 installed on the belt pressing surfaces 21*a*, 31*a* of the upper and lower belt pressing units 21, 31 and the internal belt surfaces 11*a* of the upper and lower endless belts 11 is dissipated by the cooling water flowing or circulating in the cooling water chambers 25, 35 which are provided in the interiors of the upper and lower belt pressing units 21, 31, respectively, whereby the occurrence of overheat damage trouble of the endless belts 11 is prevented.

In addition, when the friction plate 40 wears as a result of pressing directly the internal belt surfaces 11*a* of the endless belts 11, the friction plate 40 that gets so worn is removed from the belt pressing surface 21*a* of the upper belt pressing unit 21 or the belt pressing surface 31*a* of the lower belt pressing unit 31, and a new friction plate 40 is installed on the belt pressing surface 21*a* or the belt pressing surface 31*a*. This replacement work can be implemented without removing the upper oval pressure applying member 20 or the lower oval pressure applying member 30 from the main body structure, thereby making it possible to reduce largely the labors and time involved and the replacement costs incurred in the conventional replacement work.

The friction plate 40 which is made by bending the thin metallic sheet can be superposed on the belt pressing surfaces 21*a*, 31*a*, and further, in the event that the thin metallic sheet on which the sintered layer of the material having the self lubricating function is used on the front surface side 40*b* of the friction plate 40, the lubricating effect is imparted to the friction portion itself, and this obviates the necessity of the separate lubricant 50 for lubricating the internal belt surfaces 11*a* of the endless belts 11, whereby the maintenance work of the lubricant 50 is also made unnecessary which would otherwise be implemented by temporarily stopping the slitting line. In addition, since there is no liquefied lubricating oil and fat, the possibility of an operation disrupting accident of fouling the endless belts 11 and the slit band sheets a is also eliminated.

As is shown in FIG. 12, in the event that an approach is adopted in which friction plates 40 of the thin metallic sheet which are divided to match individual endless belts or a plurality of endless belts are installed to be superposed on the belt pressing surfaces 21*a*, 31*a*, friction plates 40 can be mass produced as small standard parts, whereby replacement part costs can be reduced largely. In addition, in general, since the central portion and portions there-around of the slit band sheet coiling apparatus are used more frequently, the central portion and portions there-around of the friction plate 40 wear intensely. However, only the friction plate or plates 40 at the arbitrary position where such wear occurs can be removed individually for replacement, whereby a large advantage can be provided in maintenance and control of the apparatus.

What is claimed is:

1. A multiple endless belt type band sheet coiling tension applying apparatus, comprising:

an upper and a lower set of endless belts disposed oppositely upper and lower, each set of endless belts including a plurality of endless belts laterally arranged side by side; and upper and lower pressure applying members which are inserted in an inner part of the plurality of endless belts of the upper set and lower set, respectively, and which press inner surfaces of the plurality of endless belts of the upper set and lower set, respectively, wherein a coefficient of friction of each of outer surfaces of said endless belts is larger than that of each of the inner surfaces of the endless belts;

said sets of endless belts are pressed against both surfaces of slit band sheets which are passed between the outer surfaces of said upper and lower side, oppositely arranged endless belts by the pressure applying members;

said sets of endless belts are driven to move by a friction engagement between said sets of endless belts and said slit band sheets to independently circulate said sets of endless belts in an oval shape fashion in unison with said slit band sheets;

a tension is generated in said slit band sheets by a friction force between said pressure applying members and inner surfaces of said sets of endless belts; and a friction plate is detachably installed on a surface of the upper and lower pressure applying members which presses the inner surfaces of the plurality of endless belt of the upper set and lower set, respectively, wherein the friction plates have heat conductivity which is equal to or larger than that of each of the pressure applying members, and each of the friction plates comprise a thin metallic sheet.

2. The multiple endless belt type band sheet coiling tension applying apparatus according to claim 1, wherein the pressure applying members includes oval pressure applying members, or belt pressing units with pulleys.

3. The multiple endless belt type band sheet coiling tension applying apparatus according to claim 1, wherein cooling water chambers for cooling frictional heat generated between said endless belts and said slit band sheets are provided inside the pressure applying members.

4. The multiple endless belt type band sheet coiling tension applying apparatus according to claim 1, wherein a plurality of the friction plates are provided on the upper and lower pressure applying members, respectively, laterally arranged side by side, and the plurality of frictions plates are arranged so as to correspond individually to each endless belt of the plurality of endless belts.

5. The multiple endless belt type band sheet coiling tension applying apparatus according to claim 1, wherein a thin coating having a self lubricating component is formed on a front surface side of the friction plate.

* * * * *